US008864511B2

(12) United States Patent
Shimizu et al.

(10) Patent No.: US 8,864,511 B2
(45) Date of Patent: Oct. 21, 2014

(54) TUBE LAMP AND LUMINAIRE

(75) Inventors: Keiichi Shimizu, Yokosuka (JP); Masao Hori, Yokosuka (JP); Koji Sato, Yokosuka (JP); Yuki Harada, Yokosuka (JP); Toshiyuki Hiraoka, Yokosuka (JP); Kenji Sugiyama, Yokosuka (JP); Masanao Hieda, Yokosuka (JP); Naoki Sugishita, Yokosuka (JP); Satoshi Watanabe, Yokosuka (JP); Masahiko Kamata, Yokosuka (JP); Katsusuke Uchino, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 48 days.

(21) Appl. No.: 13/634,648

(22) PCT Filed: Mar. 28, 2011

(86) PCT No.: PCT/JP2011/057528

§ 371 (c)(1),
(2), (4) Date: Sep. 13, 2012

(87) PCT Pub. No.: WO2011/122518

PCT Pub. Date: Oct. 6, 2011

(65) Prior Publication Data

US 2013/0027924 A1 Jan. 31, 2013

(30) Foreign Application Priority Data

Mar. 30, 2010 (JP) ..... 2010-077920
Apr. 27, 2010 (JP) ..... 2010-102438
Apr. 27, 2010 (JP) ..... 2010-102439

(51) Int. Cl.

| | |
|---|---|
| ***H01R 33/02*** | (2006.01) |
| ***F21V 29/00*** | (2006.01) |
| ***F21S 8/00*** | (2006.01) |
| ***F21V 27/02*** | (2006.01) |
| ***F21V 23/06*** | (2006.01) |
| ***F21V 23/00*** | (2006.01) |
| ***F21K 99/00*** | (2010.01) |
| *F21Y 101/02* | (2006.01) |
| *F21Y 103/00* | (2006.01) |
| *F21V 3/02* | (2006.01) |

(52) U.S. Cl.

CPC ..... *F21K 9/17* (2013.01); *F21V 29/225* (2013.01); *F21Y 2101/02* (2013.01); *F21S 8/031* (2013.01); *F21V 27/02* (2013.01); *F21V 29/2262* (2013.01); *F21Y 2103/003* (2013.01); *F21V 3/02* (2013.01); *F21V 23/06* (2013.01); *F21V 23/004* (2013.01)

USPC ..... 439/226

(58) Field of Classification Search

CPC .... H01R 33/08; F21V 29/004; F21Y 2101/02
USPC ..... 439/226, 239–244
See application file for complete search history.

(56) References Cited

U.S. PATENT DOCUMENTS 7,594,738 B1 9/2009 Lin et al.
2007/0242466 A1 10/2007 Wu et al.

(Continued)

FOREIGN PATENT DOCUMENTS

CN 102252177 A 11/2011
DE 20 2005 020471 U1 2/2006

(Continued)

OTHER PUBLICATIONS

International Search Report of International Application No. PCT/JP2011/057528 dated Apr. 19, 2011.

(Continued)

*Primary Examiner* — Phuongchi T Nguyen
(74) *Attorney, Agent, or Firm* — Patterson & Sheridan LLP

(57) ABSTRACT

Both ends of a lamp body are mounted on sockets of an apparatus body and a feeding unit configured to feed power to LEDs is provided on the back side facing the apparatus body of the lamp body.

12 Claims, 27 Drawing Sheets

(56) References Cited

U.S. PATENT DOCUMENTS

| | | | | |
|---|---|---|---|---|
| 2010/0270925 | A1* | 10/2010 | Withers | 315/51 |
| 2011/0235319 | A1 | 9/2011 | Fukano et al. | |

FOREIGN PATENT DOCUMENTS

| | | | |
|---|---|---|---|
| JP | 3142652 | U | 3/2001 |
| JP | 2001351402 | A | 12/2001 |
| JP | 3119578 | U | 3/2006 |
| JP | 2010062023 | A | 3/2010 |
| JP | 2010067367 | A | 3/2010 |

OTHER PUBLICATIONS

Supplementary EP Search Report dated Feb. 13, 2014 for Application No. 11 76 2742.

Written Opinion of the International Searching Authority, International Application No. PCT/JP2011/057528, dated Oct. 23, 2012.

Chinese Office Action dated Jul. 3, 2014, for Application No. 201180014683.0.

* cited by examiner

TUBE LAMP AND LUMINAIRE

CROSS REFERENCE TO RELATED APPLICATION

This is a U.S. national phase application under 35 U.S.C. 371 of International Application No. PCT/JP2011/057528, filed on Mar. 28, 2011 and published in Japanese.

TECHNICAL FIELD

Embodiments of the present invention relates to a tube lamp which can be used instead of a tube fluorescent lamp and uses, for example, LEDs as light sources, and to a luminaire using the tube lamp.

BACKGROUND ART

In recent years, LEDs (light-emitting diodes) having a high output and high light-emitting efficiency are now in widespread use, and development of luminaire using the LEDs as light sources regardless of whether the lamp is for indoor or outdoor is in progress. The luminaire using the LEDs has a long service life and consumes leas power in comparison with existing luminaire such as fluorescent lamps. Therefore, running cost is low and the number of times of replacement of equipment or maintenance on the basis of service life can foe reduced.

For example, a straight tube lamp using LEDs arranged in a row as light sources, which can be used by being replaced instead of existing straight tube fluorescent lamp is in widespread use.

Cited List

Patent Literature

[PTL1] Jp-A-2001-351402

SUMMARY OF INVENTION

Solution Problem

However, since the tube lamp using the current LEDs has a structure to be mounted and feed power by inserting bases provided at both ends thereof into sockets on an apparatus body side, it is necessary to provide a complicated circuit configuration on a lamp side in conformity to a lighting system on the apparatus body side. Therefore, the cost of the lamp is inevitably increased.

Also, a force of the sockets of the existing apparatus body to hold the bases may be weakened due to aging degradation, and there is a risk of dropping of the tube lamp, and electrical connection may result in a higher rate of unstable electric connection.

Therefore, development of a tube lamp which provides a high compatibility with existing straight tube fluorescent lamps, can be manufactured by itself at low cost, and has no fear of dropping from the apparatus body, and a luminaire using such a tube lamp is desired.

Solution to Problem

A tube lamp of an embodiment comprising: an elongated cylindrical lamp body having translucency; a plurality of light-emitting elements arranged in the lamp body; two mounting portions configured to mount both ends of the lamp body in the longitudinal direction respectively to sockets of an apparatus body;

and a feeding unit provided on the lamp body separately from the two mounting portions for feeding power to the light-emitting element.

Advantageous Effects of Invention

In an embodiment, a tube lamp which provides a high compatibility with existing straight tube fluorescent lamps, can be manufactured by itself at low cost, and has no fear of dropping from the apparatus body, and a luminaire using such a tube lamp can be provided.

BRIEF DESCRIPTION OF DRAWINGS

FIG. 4 is mounted on an apparatus body.

DESCRIPTION OF EMBODIMENTS

Figure 1:
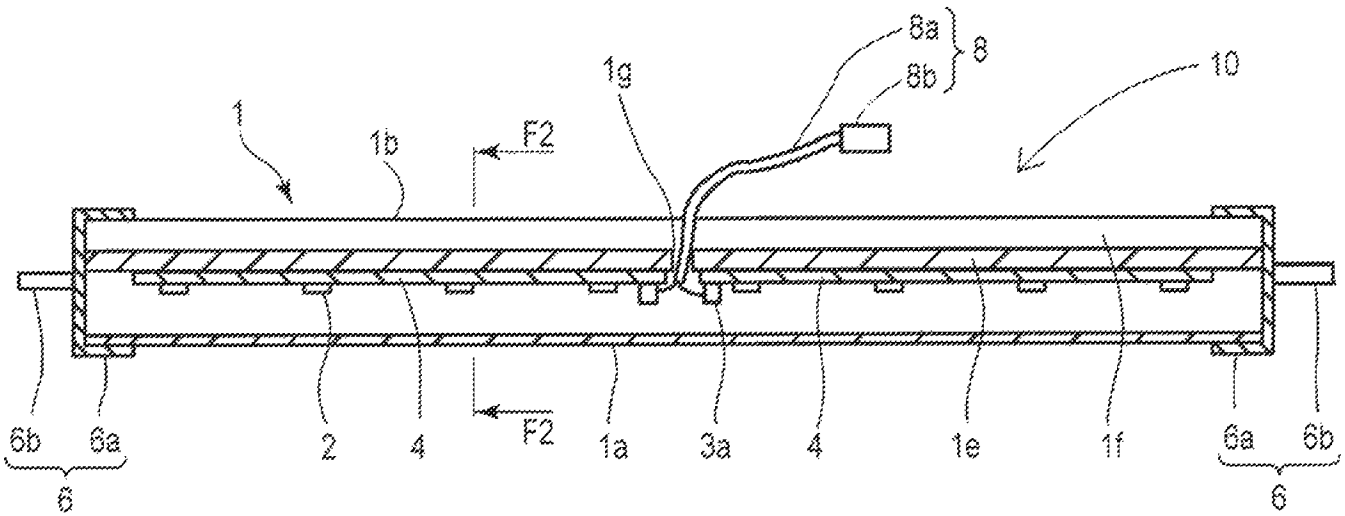
FIG. 1 is a cross-sectional view of a tube lamp according to a first embodiment taken along a tube axis.

Referring now to the drawings, an embodiment will be described in detail.

Figure 2:
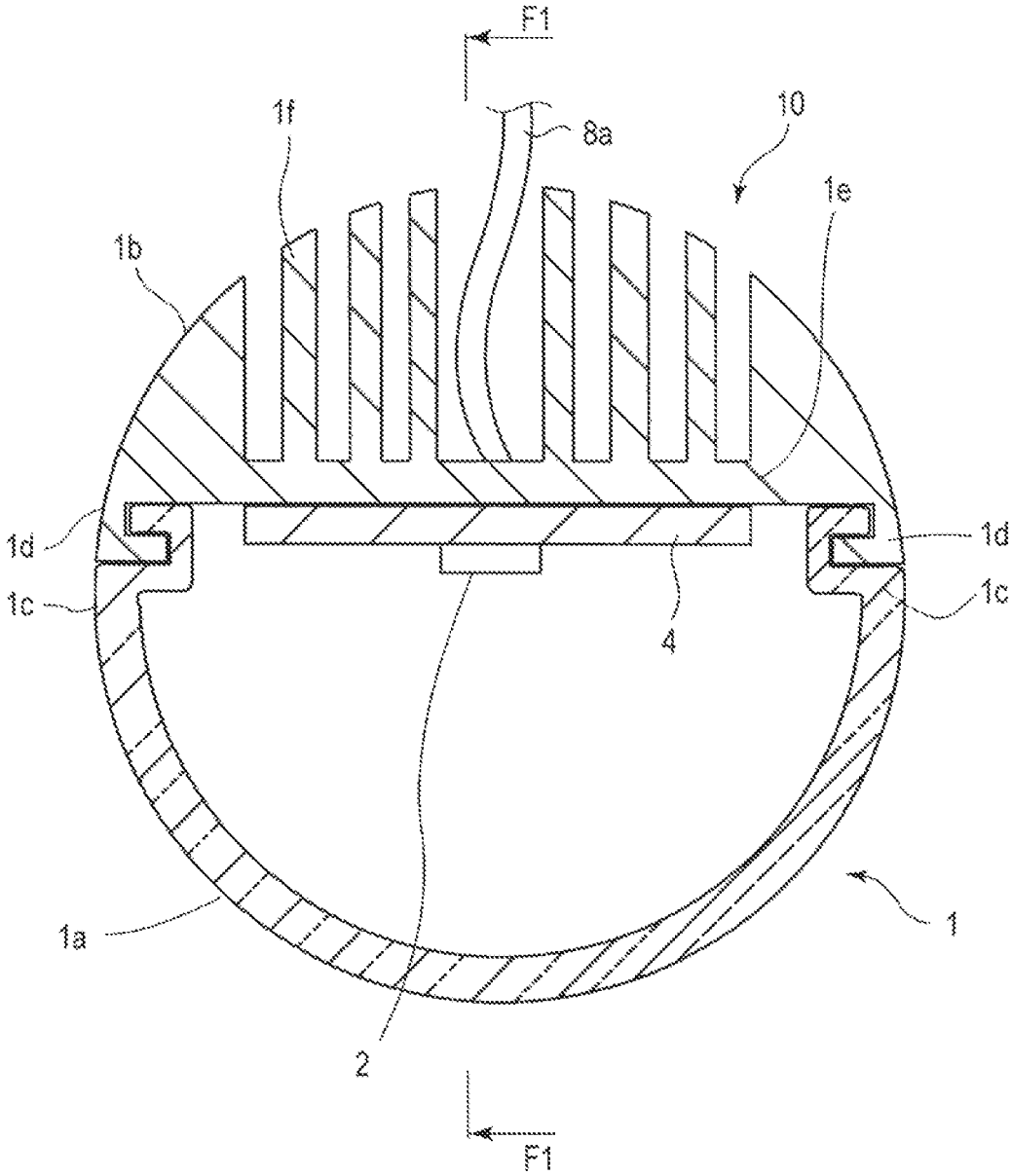
FIG. 2 is a cross-sectional view of the tube lamp in FIG. 1 taken along a plane orthogonal to the tube axis.

FIG. 1 illustrates a cross-sectional view of a tube lamp 10 according to a first embodiment taken in a longitudinal direction along a tube axis thereof. FIG. 2 shows a cross-sectional view of the tube lamp 10 taken along a plane orthogonal to the tube axis thereof. In the respective embodiments describe below, a straight tube lamp having a substantially cylindrical shape extending straight as illustrated in FIG. 1 will be described as an example of tube lamps.

The tube lamp 10 has a structure which can be used instead of an existing straight tube fluorescent lamp (not illustrated). In other words, the tube lamp 10 in this embodiment can be used by being mounted on an apparatus body 100 (described in detail later) of a luminaire configured to be used by mounting the straight tube fluorescent lamp in the related art.

The tube lamp 10 in this embodiment includes an elongated straight tube lamp body 1 of a substantially cylindrical shape, a plurality (eight in this embodiment) of LEDs 2 (light-emitting elements) arranged in a line in the longitudinal direction in the lamp body 1, two substrates 4 on which the plurality of LEDs 2 are mounted, two bases 6 (mounting portion) mounted respectively on both ends of the lamp body 1 in the longitudinal direction for mounting the lamp body 1 on the apparatus body 100 and feeding unit 8 configured to feed power to eight of the LEDs 2.

The tube lamp 10 in this embodiment is characterised by a structure in which a plurality of the LEDs 2 are disposed side by side along the direction of an tube axis, and eight of the LEDs 2 are mounted on the two substrates 4, that is, four on each of the substrates 4, respectively. The feeding unit 8 is provided on the back side of the lamp body 1 in the direction in which the tube 10 faces the apparatus body 100.

The lamp body 1 includes a translucent cover 1*a*, and a thermal radiating unit 1*b* formed of an aluminum extruded material. The cover 1*a* has a shape obtained by cutting a substantially cylindrical shape along a center line thereof, and includes engaging edge portions 1*c* extending in the longitudinal direction for engaging the thermal radiating units 1*b* at both side edge portions facing the thermal radiating unit 1*b*. The material of the cover 1*a* is preferably a material which can diffuse light.

In contrast, the thermal radiating unit 1*b* includes engaging step portions 1*d* extending in the longitudinal direction for allowing engaging edge portions 1*c* of the cover 1*a* to be fitted thereto. In a case where the lamp body 1 is assembled by fitting the cover 1*a* and the thermal radiating unit 1*b*, the cover 1*a* is slid in she longitudinal direction to engage the engaging edge portions 1*c* arid the engaging step portions 1*d*.

The thermal radiating unit 1*b* integrally includes a mounting base 1*e* for mounting the substrates 4 on which the LEDs 2 are mounted, and a plurality of thermal radiating fins if extending upright from a back side (upper side in FIG. 2) of the mounting base 1*e*. The material of the thermal radiating unit 1*b* is preferably a metallic material having high thermal efficiency.

Provided in the vicinities of the end portions of the two substrates 4 facing each other are connectors 3*a* for connecting a feeding wire 8*a* respectively. Formed on the mounting base 1*e* located in a gap between the two substrates 4 is a lead hole 1*g* penetrating therethrough for leading out the feeding wire 8*a* connected to the connectors 3*a* from the back side of the lamp body 1 to the outside. The feeding wire 8*a* led via the lead hole 1*g* is drawn out to the back side of the lamp body 1 from between the thermal radiating fins 1*f*.

Figure 5:
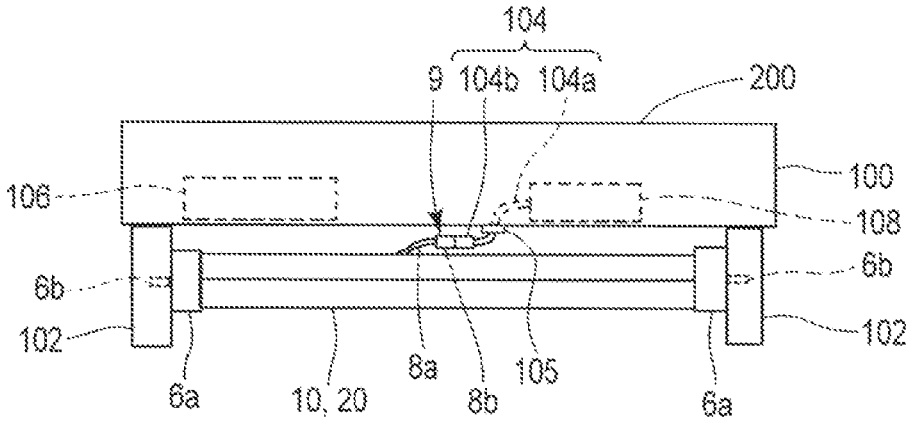
FIG. 5 is a schematic view of a luminaire in which the tube lamp in FIG. 1
Figure 6:
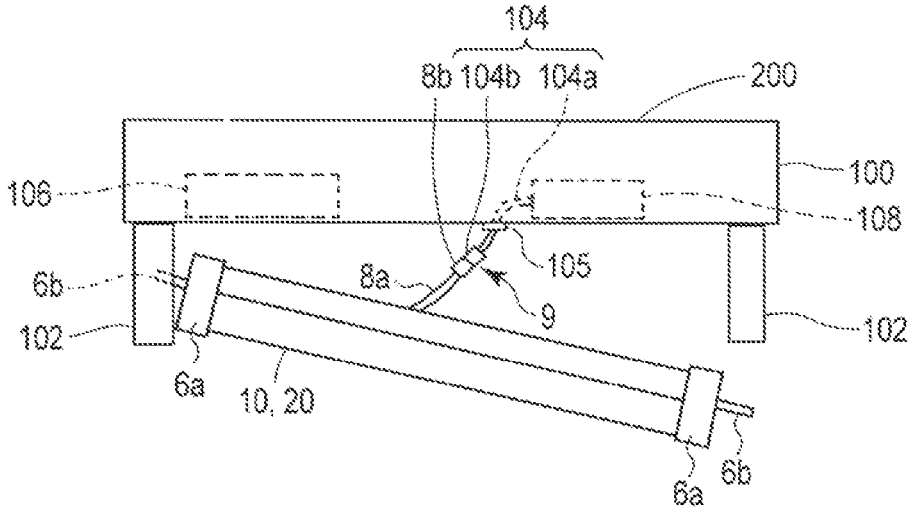
FIG. 6 is a schematic view illustrating a state in which a base of the tube lamp comes off from one of sockets of the apparatus body in FIG. 5.

The two bases 6 are provided so as to support both ends of the lamp body 1 respectively with respect to the apparatus body 100 of the luminaire to which the existing straight tube fluorescent lamp (not illustrated) can be mounted as illustrated in FIG. 5 and FIG. 6. In other words, the lamp body 1 is mounted on the apparatus body 100 by mounting the two bases 6 located at the both ends thereof no two sockets 102 of the apparatus body 100, respectively.

The two bases 6 have a strength enough to support the own weight of the lamp body 1. Each of the two bases 6 integrally includes a bottomed cylindrical shaped cap 6*a* (fixture) to be mounted at an end portion of the lamp body 1 and two pins 6*b* (connectors) projecting from the bottom of the cap 6*a*. The two pins 6*b* are connected to terminals of the sockets 102 of the apparatus body 100. The shape of the terminals of the bases 6 is determined according to the shape of the terminals of the sockets 102 on the apparatus body 100 side.

The cap 6*a* arm; the pins 6*b* are formed respectively of a metal. In other words, the two bases 6 have thermal conductivity, respectively. Then, the two bases 6 are mounted respectively to the both ends of the lamp body 1 by bonding the caps 6*a* to the end portions of the lamp body 1 by caulking or with an adhesive agent such as a resin.

However, the bases 6 in this embodiment is not provided as feed terminals for feeding electricity from the apparatus body 100 side to the lamp body 1, and is simply be provided for mounting the lamp body 1 to the apparatus body 100.

Therefore, the bases 6 are connected to the sockets 102 of the apparatus body 100 in an insulated state. Alternatively, the two pins 6*b* of the bases 6 are connected to the caps 6*a* in the insulated state. Alternatively, the two pins 6*b* of the respective bases 6 are in the insulated state with respect to each other.

In other words, the bases 6 are electrically opened, and even when electricity is supplied to the two pins 6*b* from the side of the apparatus body 100 to the two pins 6*b* via the sockets 102, the LEDs 2 in the lamp body 1 are not energized via the bases 6. In other words, when an attempt is made to mount the tube lamp 10 in this embodiment to the existing apparatus body 100, it is necessary to provide the feeding unit 8 for feeding electricity to the plurality of LEDs 2 separately from the two bases 6.

The feeding unit 8 is provided on the lamp body 1 for connecting the lamp body 1 to an external power supply for supplying power to the LEDs 2. More specifically, the feeding unit 8 includes the feeding wire 8*a* connected to the connectors 3*a* mounted on the substrates 4 and a connector 8*b* provided at a distal end of the feeding wire 8*a*.

The feeding wire 8*a* is led out from the back side of the lamp body 1 via the lead hole 1*g* of the thermal radiating unit 1*b*, and in a midcourse thereof, is fixed to the lamp body 1 by a tensile force stopper or the like, not illustrated here. In this manner, by fixing the feeding wire 8*a* to the lamp body 1 by the tensile force stopper or the like, a stress applied to the feeding wire 8*a* is prevented from being applied to connecting portions with respect to the connectors 3*a* on the substrates 4. For example, even when the feeding wire 8*a* is pulled, application of an unintended force to the connectors 3*a* is prevented.

Figure 3:
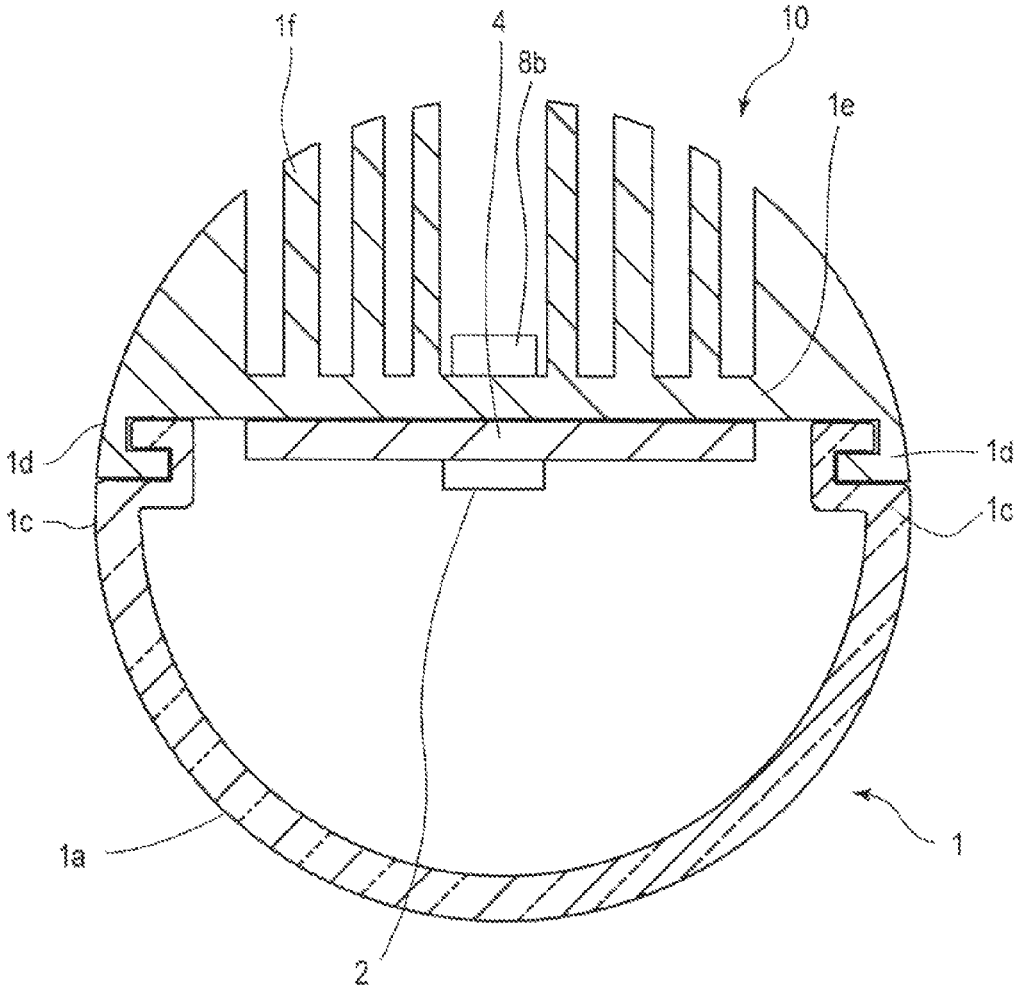
FIG. 3 is a cross-sectional view of the tube lamp in FIG. 2, illustrating a state in which a connector of a feeding unit is fixedly provided on a lamp body.

Alternatively, in order to eliminate the stress applied to the feeding wire 8*a*, fixation may be achieved by storing the feeding wire 8*a* in the lamp body 1, and fixing the connector 8*b* to the lamp body 1 by direct mount. In this case, for example, as illustrated in FIG. 3, the connector 8*b* of the feeding unit 8 is secured to the back side of the mounting base 1*e* between the thermal radiating fins 1*f*.

The feeding unit 8 (the feeding wire 8*a* and the connector 8*b*) is provided on the back side in the direction in which the lamp body 1 faces the apparatus body 100. Therefore, in a state in which the lamp body 1 is mounted on the apparatus body 100, the feeding wire 8*a* and the connector 8*b* are hidden on the back side of the lamp body 1, and the feeding wire 8*a* and the connector 8*b* can hardly be seen from the front side of the luminaire, that is, from the side where illuminating light is extracted.

In contrast, a connecting portion 104 on the apparatus body 100 side for connecting the feeding unit 8 of the lamp body 1 to the apparatus body 100 includes a connector 104*b* to be connected to the connector 8*b* of the feeding unit 8 and a connecting wire 104*a* having the connector 104*b* at one end thereof. The feeding wire 8*a* and the connector wire 104*a* connected via the connectors 8*b*, 104*b* function as a feeding wire 9 for feeding power to the plurality of LEDs 1.

As described score, the translucent cover 1*a* and the thermal, radiating unit 1*b* define a space for disposing the LEDs 2 in the interior of the lamp body 1. In other words, the outline of the lamp body 1 has a substantially cylindrical shape, and the cover 1*a* provides at least part of the lamp body 1 with translucency, In contrast, the LEDs 2 disposed in the lamp body 1 face the inner surface of the cover 1*a*. Therefore, when the LEDs 2 are lit, light radiated from the LEDs 1 is radiated from the front of the tube lamp 10 via the cover 1*a*.

According to the tube lamp 10 of the embodiment, the LEDs 2 are lit by receiving a supply of power from the outside via the feeding unit 8, In other words, the bases 6 at the both ends of the lamp body 1 are provided only for causing the socket 102 of the apparatus body 100 to support the lamp body 1. Therefore, according to the present embodiment, irrespective of the lighting method of the existing luminaire, the tube Lamp 10 which can supply desired power to the lamp body 1 via the feeding unit 8, and enhance general versatility is provided.

According to the present embodiment, even though the sockets 102 of the apparatus body 100 of the existing luminaire is subjected to aging degradation, since the supply of power through the feeding unit 8 provided separately from the bases 6 is possible, reliability of electrical connection can be secured.

In contrast, when the sockets 102 are subjected to the aging degradation, there is a risk of dropping of the tube lamp 10. However, in this embodiment, since the lamp body 1 and the apparatus body 100 are connected via the feeding wire 9, even when the bases 6 come apart from the sockets 102, there is no risk of dropping of the lamp body 1.

Furthermore, according to this embodiment, since the feeding unit 8 is led out from the vicinity of the center of the lamp body 1 in the direction of the tube axis as illustrated in FIG. 1, when mounting the bases 6 of the tube lamp 10 to the sockets 102 of the apparatus body 100, the feeding wire 8*a* or the connector 8*b* of the feeding unit 8 can hardly interfere with the bases 6 and the sockets 102. Therefore, even though the feeding wire 8*a* is led out from the lamp body 1, the mounting workability of the lamp body 1 may be facilitated.

Figure 4:
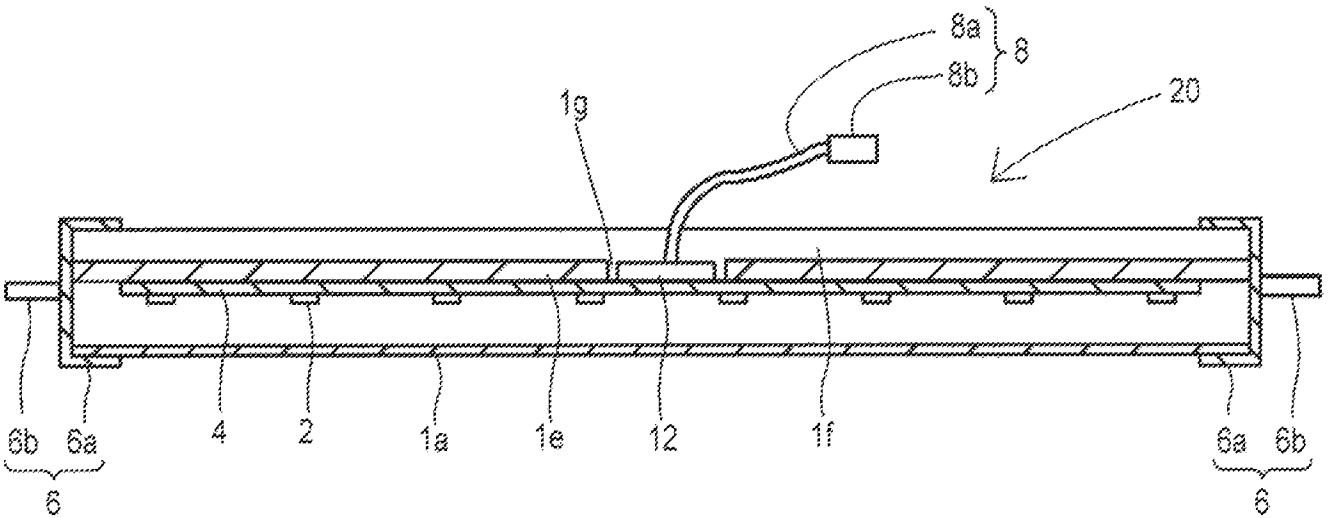
FIG. 4 is a cross-sectional view of a tube lamp according to a second embodiment taken along a tube axis.

FIG. 4 illustrates a cross-sectional view of a tube lamp 20 according to a second embodiment.

The tube lamp 20 has the same structure as the above-described first embodiment except that a lighting circuit 12 is mounted in the lamp body 1. Therefore, the components which function in the same manner as the first embodiment described above are designated by the same reference signs, and the detailed description is omitted.

As illustrated in FIG. 4, in the tube lamp 20 of this embodiment, the lighting circuit 12 is mounted on the back side of the substrates 4, and the feeding wire 8*a* of the feeding unit 8 is drawn out from the lighting circuit 12. Then, the connector 8*b* of the feeding unit 8 is connected to a commercial power supply, not illustrated here. In other word, the commercial power is supplied to the lighting circuit 12.

The lighting circuit. 12 generates a lighting power for lighting the LEDs 2 from the supplied commercial power, and supplies the same to the LEDs 2. In this embodiment, the lighting circuit 12 is disposed in the lead hole 1*g* of the mounting base 1*e*, an the feeding wire 8*a* of the feeding unit 8 is led out from near the center of the lamp body 1 in the direction of the tube axis to the outside. In this case, the shape and the size of the lead hole 1*g* is set so as to be in conformity to the lighting circuit 12.

In this case, the power supplied to the feeding unit 8 is not specifically limited. However, when supplying the commercial power at a rating of 200V or higher, a configuration in which the tube lamp 20 side and the commercial power supply side can be brought into an earth connection by connecting the connector 8*b* of the feeding unit 8 with the commercial power supply is preferable.

In this manner, since a configuration in which the commercial power is supplied to the feeding unit 8 of the tube lamp 20 is employed, when the existing fluorescent lamp of the luminaire using the straight fluorescent lamp already set is replaced by the tube lamp 20 in this embodiment, a burden imposed at the time of replacement is reduced.

Also, for example, when replacing the tube lamp 10 having different circuit configuration such as the difference in rating, replacement is easily achieved if the connecting, portion 104 for supplying power from the apparatus body 100 side to the feeding unit 8 is led out.

Also, the lighting circuit 12 to be disposed in the tube lamp 20 may be part of the lighting circuit for lighting control of the LEDs 2. In other words, the tube lamp 20 is supported by the sockets 102 configured to hold the fluorescent lamp of the related art, and therefore, the lighter weight is preferable.

Accordingly, by disposing the common circuit portion on the apparatus body 100 side and disposing only part of the lighting circuit on the lamp body 1, the light weight of the tube lamp 20 is achieved and the burden imposed at the time of replacement is also reduced. For example, it may be achieved by disposing a circuit configured to convert the commercial power supply to DC power supply on the apparatus body 100 side, and disposing the circuit configured to supply power from the DC power supply to the LED 2 in the lamp body 1.

In this embodiment, as illustrated in FIG. 4, the substrate is composed of a single substrate 4, and the lighting circuit 12 is mounted on the back side of the substrate 4 and the lighting circuit 12 is disposed in the lead hole 1*g*. However, this embodiment is not limited thereto, and a storage portion for disposing the lighting circuit 12 on the mounting base 1*e* may be provided, or the lighting circuit 12 may be disposed on the mounting surface side of the substrate 4 where the LEDs 2 are disposed, or may be configured as a member separate from the substrate 4.

FIG. 5 illustrates a schematic drawing of a luminaire 200 with either one of the tube lamps 10 and 20 according to the first and second embodiment described above mounted on the apparatus body 100. FIG. 6 illustrates a schematic drawing illustrating a state in which one (right side in the drawing) of the bases 6 of the tube lamp 10 or 20 come apart from the sockets 102 from the state illustrated in FIG. 5.

The apparatus body 100 of the luminaire 200 includes the two sockets 102 provided respectively at both ends in the longitudinal direction thereof. The respective sockets 102 are suspended from a lower surface side of the apparatus body 100 at both ends in the longitudinal direction. The tube lamp 10 or 20 is disposed between these two sockets 102 and is mounted on the apparatus body 100 by connecting the bases 6 on the both ends to the terminal of the sockets 102.

The apparatus body 100 includes a lighting apparatus 106 which is capable of supplying power to terminals, not illustrated, of the sockets 102. The lighting apparatus 106 is for a lighting control of the existing straight fluorescent lamp. In other words, since the lighting apparatus 106 is an unnecessary configuration when using the tube lamp 10 or 20 in the respective embodiment described above, the lighting apparatus 106 may be removed at the same time as the replacement of the tube lamp 10 or 20. However, the lighting apparatus 106 may be retained in the apparatus body 100 as-is.

Furthermore, the apparatus body 100 includes a lighting apparatus 108 for a lighting control of the plurality of LEDs 2 of the tube lamp 10 or 20. A proximal end portion of the connecting wire 104*a* of the connecting portion 104 described above is connected to the lighting apparatus 108. As described above, the connector 104*b* of the connecting portion 104 is connected to the connector 8*b* of the feeding unit 8 on the lamp body 1 side. Then, the power from the lighting apparatus 108 is supplied to the feeding unit 8 via the connecting portion 104.

The connecting wire 104*a* led from the apparatus body 100 is fixed to the apparatus body 100 by a tensile force stopper 105 at a midpoint thereof. Accordingly, even when the connecting wire 104*a* is pulled unintentionally, there is no fear of application of an unintentional stress to the connecting portion of the proximal end portion of the connector 104*b* with respect to the lighting apparatus 108.

Figure 7:
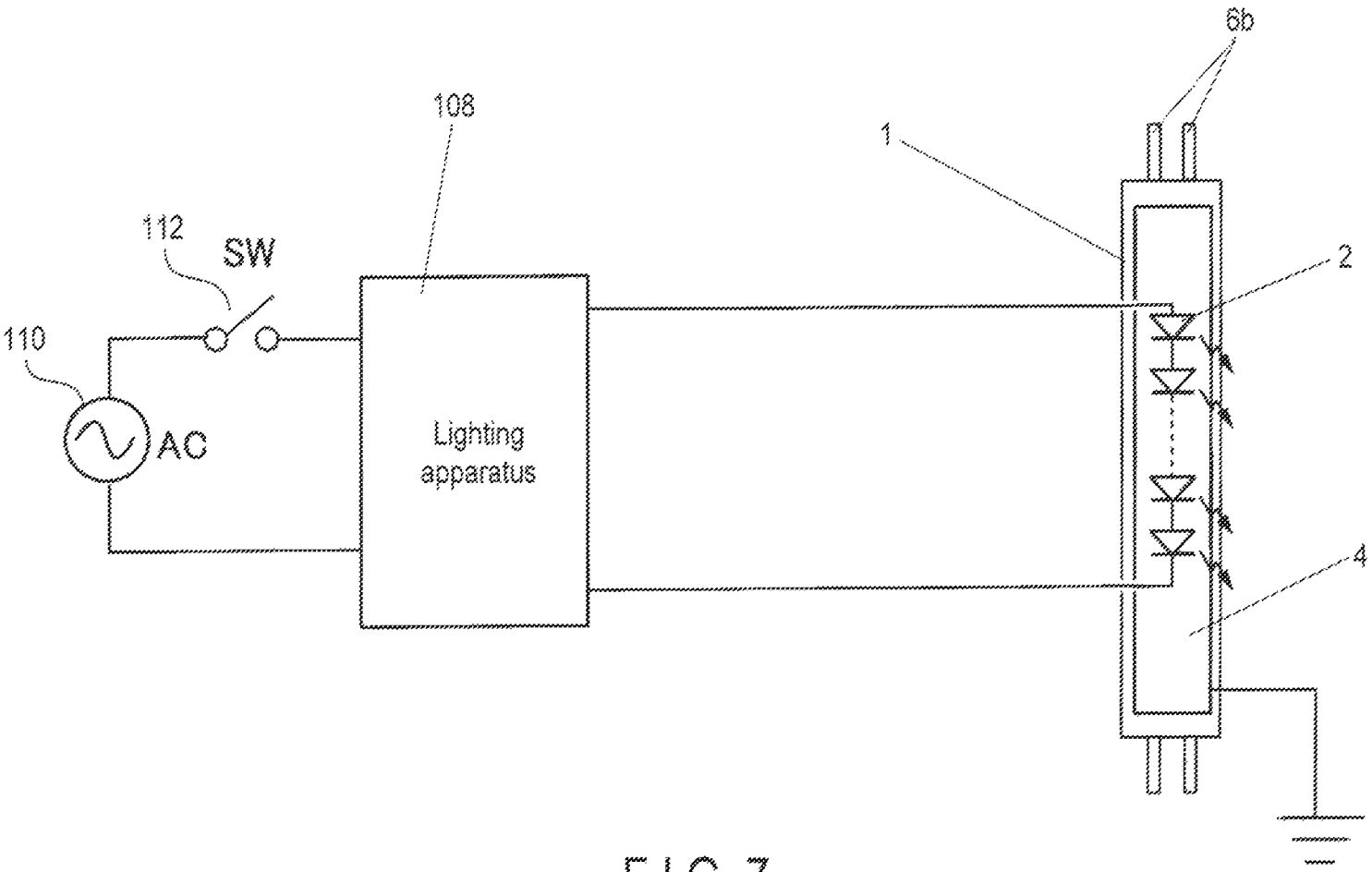
FIG. 7 is a circuit diagram of the luminaire in FIG. 5.

FIG. 7 illustrates a circuit diagram of the luminaire 200 described above.

The lighting apparatus 108 is connected to a plurality of the LEDs 2 via the feeding wire 9. The feeding wire 9 described here includes the feeding wire 8*a* and the connector 8*b* of the feeding unit 8 on the lamp body 1 side and the connecting wire 104*a* and she connector 104*b* of the connecting portion 104 on the side the apparatus body 100 as described above.

A commercial AC power supply 110 is connected to the lighting apparatus 108, and the plurality of LEDs 2 can be lit and extinguished by turning a switch 112 ON and OFF. As illustrated in FIG. 7, no power supply is connected to the bases 6 at the both ends of the lamp body 1 in the longitudinal direction, and electrically opened state is assumed.

A method of replacing the existing straight fluorescent lamp by the above-described tube lamp 10 or 20 in the embodiments will be described with reference mainly to FIG. 5 and FIG. 6.

First of all, the straight tube fluorescent lamp is disconnected from the apparatus body 100 of the luminaire 200 in a state of being installed on a ceiling surface or the like on the building. Then, the lighting apparatus 108 is mounted on the apparatus body 100. The commercial power supply is connected to the lighting apparatus 108. At this time, the unnecessary lighting apparatus 106 for the fluorescent lamp may be removed from the apparatus body 100. At this time, part of the apparatus body 100 is formed with an insertion hole for leading out the connecting wire 104*a*. Then, the connecting wire 104*a* is lead out to the outside from the apparatus body 100 through the insertion hole. Furthermore, the midsection of the connecting wire 104*a* is fixed to the apparatus body 100 by the tensile force stopper 105.

Subsequently, the bases 6 at the both ends of the tube lamp 10 or 20 are mounted to the respective sockets 102. At this time, simultaneously, the connector 8*b* at a distal end of the feeding wire 8*a* led out from the tube lamp 10 or 20 and the connector 104*b* at the distal end of the connecting wire 104*a* are connected.

In this manner, when mounting the tube lamp 10 or 20 on the apparatus body 100, by connecting the feeding unit 8 on the lamp body 1 side and the connecting portion 104 on the apparatus body 100 side, a problem of dropping of the lamp body 1 at the time of mounting the tube lamp 10 or 20 may be prevented. In other words, in this case, the lamp body 1 is suspended and supported with respect to the apparatus body 100 via the feeding wire 9. In this case, since the respective components 8*a*, 8*b*, 104, and 104*b* of the feeding wire 9 do not interfere with the sockets 102 or the bases 6, mounting of the bases 6 on the sockets 102 is not disturbed.

As described above, when the commercial power is supplied to the lighting apparatus 108 via the AC power supply 110 in a state in which the tube lamp 10 or 20 is mounted on the apparatus body 100, a lighting power is supplied to the plurality or LEDs 2 via the connecting portion 104 and the feeding unit 8, and the plurality of LEDs 2 emit light.

In a method of mounting the tube lamp described above, a case where an operation to connect the feeding unit S and the connecting portion 104 is performed simultaneously with an operation to mount the bases 6 to the sockets 102 is described. However, the feeding unit 8 and the connecting portion 104 may be configured to be connected automatically by the operation of connecting the bases 6 to the sockets 102. For example, a method of fixing parts of the feeding unit 8 and the connecting portion 104 to be connected via the connector respectively to the lamp body 1 and the apparatus body 100 to achieve a positional relationship so that the both are connected when the bases 6 is mounted on the sockets 102 is conceivable. According to this method, the feeding unit 8 and the connecting portion 104 can be connected via the connector by the operation to mount the bases 6 to the sockets 102.

By employing the connecting structure described above, interference of lead wires or connectors of the feeding; unit 8 and the connecting portion 104 with the sockets 102 or the bases 6 is avoided, so that the connecting operation between the feeding unit 8 and the connecting portion 104 is facilitated.

It is also possible to set the positions to fix the feeding unit 8 and the connecting portion 104 so one of the ends side of the lamp body 1 and one of the sockets 102 side of the apparatus body 100, and provide mounting structures for mounting the tube lamp 10 or 20 on the apparatus body 100 on the other of the end sides of the lamp body 1 and the other of the sockets 102 to the lamp body 1 and the apparatus body 100, respectively. These mounting structures only have to be the same structure as the connecter connection between the feeding unit 8 and the connecting portion 104. However, power does not have to be supplied, and only the other side of the tube lamp 10 or 20 has to be supported by the apparatus body 100.

In this manner, by configuring the tube lamp 10 or 20 to be supported by the apparatus body 100 by the connector connection between the feeding unit 8 and the connecting portion 104 and the engagement on the basis of the mounting structure at the both ends of the tube lamp 10 or 20, respectively, even though the sockets 102 are deteriorated and the bases 6 cannot obtain sufficient supporting force from the sockets 102, the tube lamp 10 or 20 can be mounted on the apparatus body 100.

FIG. 6 is a drawing illustrating a state in which a support of one (right side in the drawing) of the bases 6 of the tube lamp 10 or 20 comes apart. As illustrated in FIG. 6, even though at least one of the bases 6 comes apart, the tube lamp 10 or 20 can be maintained by the connection between the feeding unit 8 and the connecting portion 104 and the engagement between the other base 6 and the sockets 102.

In other words, in this case, the feeding wire 9 support a portion of the lamp body 1 near the center and the other base 6 of the lamp body 1 is supported by the sockets 102. Therefore, even though one of the bases 6 comes apart, dropping of the tube lamp 10 or 20 does not occur, and also the fact that the sockets 102 are deteriorated is notified to users.

Since the feeding unit 8 is led out from the portion of the lamp body 1 in the vicinity of the center along the direction of an tube axis, a load applied to the engaging portion between the feeding unit 8 and the connecting portion 104 is reduced as illustrated in FIG. 6, and hence the tube lamp 10 or 20 can be held with a smaller engaging force.

When the existing straight fluorescent lamp is replaced by the tube lamp 10 or 20, it is imagined that the apparatus body 100 has been used already to some extent. If it is used for a long time, there is a risk of dropping of the bases 6 of the tube lamp 10 or 20 from the sockets 102 due to the deterioration of the sockets 102 under the influence of, specifically, heat or UV rays, or due to vibrations or any other reasons.

However, even when the bases 6 drop from the sockets 102, the probability of dropping of the two bases 6 at the both ends of the lamp body 1 from the sockets 102 simultaneously is low. Normally, either one of those drops first. In this embodiment, it is configured that even though at least one of the bases 6 comes apart, the tube lamp 10 or 20 can be maintained by the engagement between the feeding unit 8 and the connecting portion 104 and the engagement between the other base 6 and the socket 102. Therefore, even when the tube lamp 10 or 20 is used instead of the straight fluorescent lamp for the apparatus body 100 of the luminaire 200 which is subjected to aging degradation after a long time of usage, the safety can be ensured. In particular, by configuring that the own weight of the tube lamp 10 or 20 can be supported by the connection between the feeding unit 8 and the connecting portion 104, the safety is further secured.

Referring now to FIG. 8 to FIG. 16, a third embodiment will be described. In the following description, the components which function as those in the first and second embodiments are designated by the same reference signs, and detailed description may be omitted.

Figure 8:
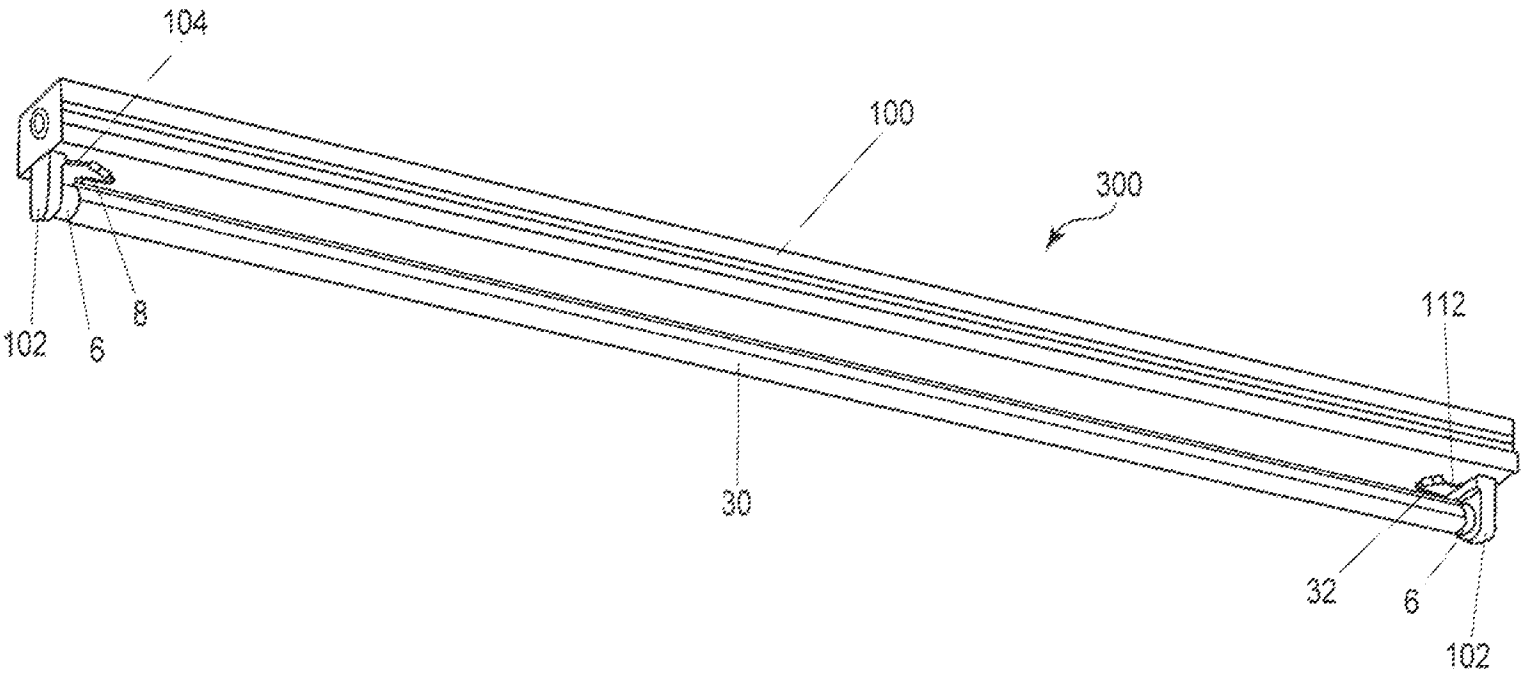
FIG. 8 is an appearance perspective view illustrating a luminaire according to a third embodiment.
Figure 9:
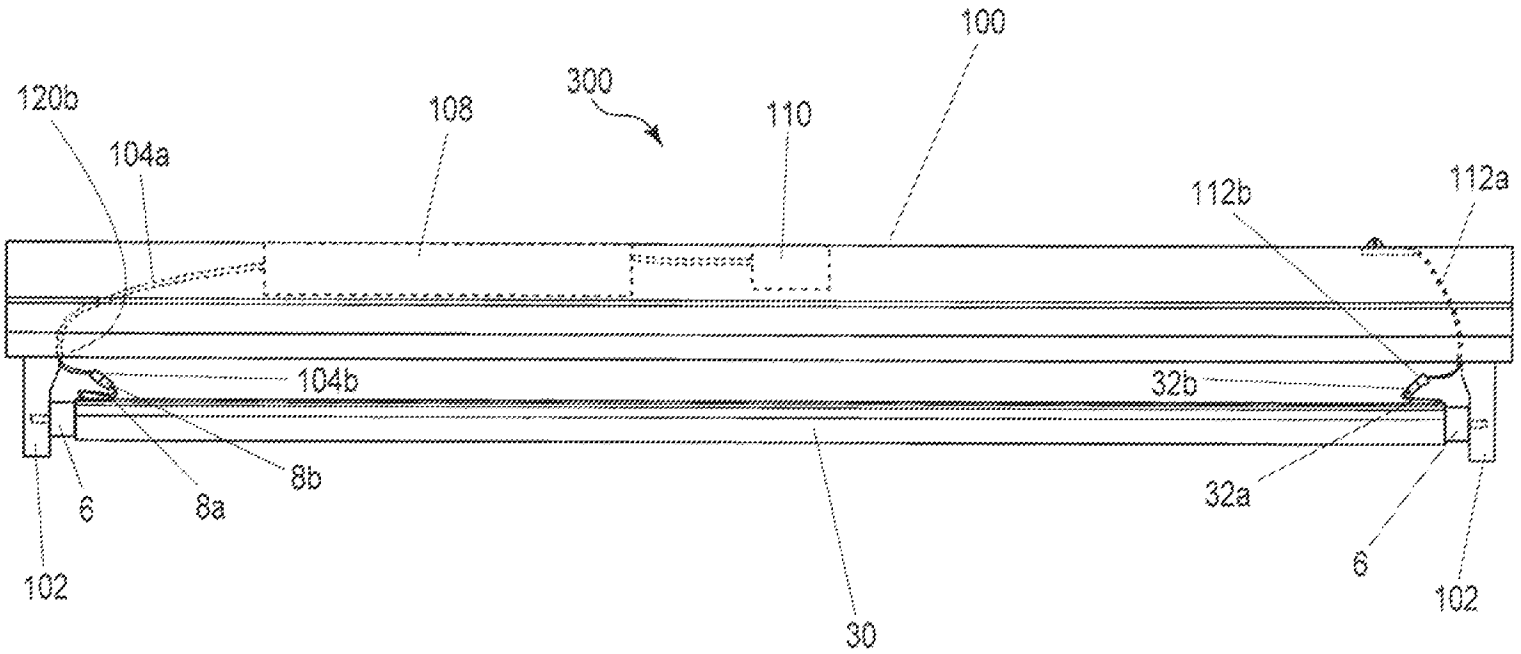
FIG. 9 is a side view of the luminaire in FIG. 8 viewed from a side.
Figure 10:
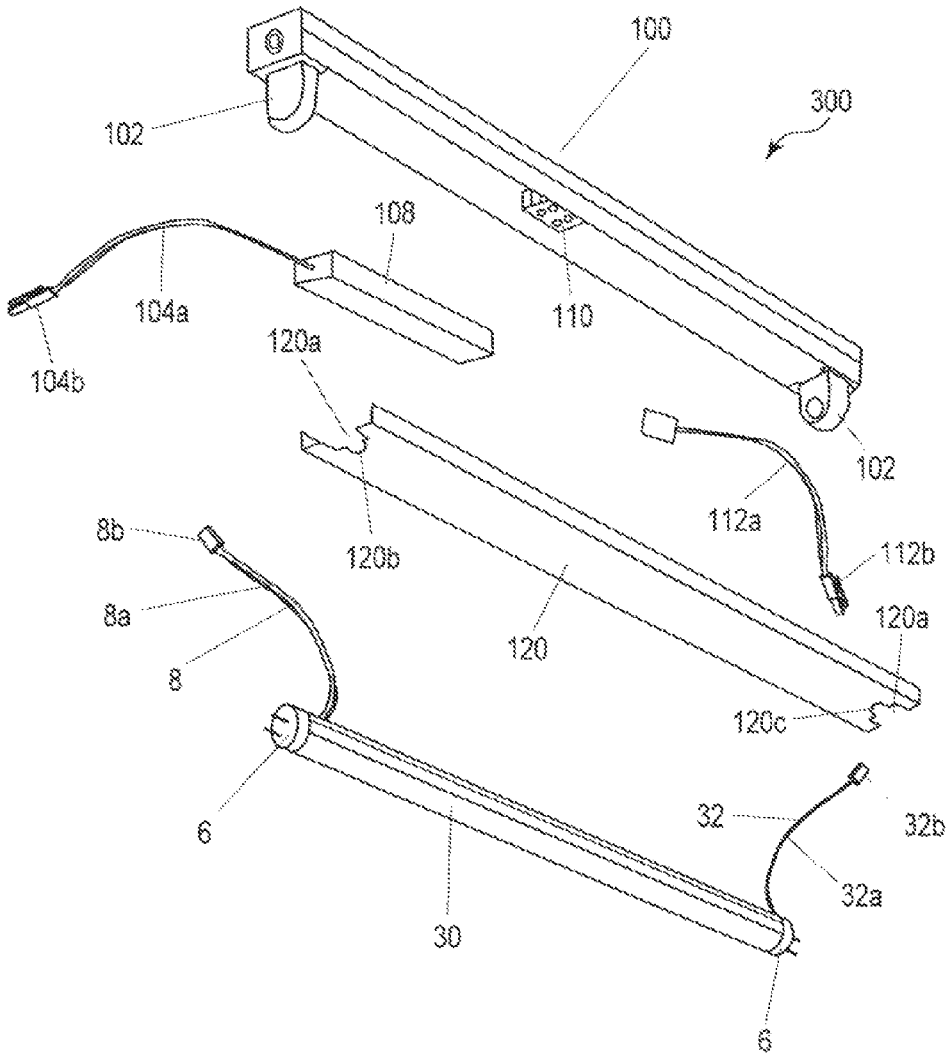
FIG. 10 is an exploded perspective view of the luminaire in FIG. 8.

FIG. 8 illustrates an appearance perspective view of a luminaire 300 of this embodiment, and FIG. 9 illustrates a side view of the luminaire 300 viewed from the side. FIG. 10 also illustrates an exploded perspective views of the luminaire 300. The luminaire 300 of this embodiment also includes the apparatus body 100 to be mounted on the ceiling surface or the like of the building and a tube lamp 30 to be mounted on the apparatus body 100.

The apparatus body 100, in which the existing straight fluorescent lamp has been mounted, has a structure which allows the straight fluorescent lamp to be replaced by the tube lamp 30. In other words, the apparatus body 100 is configured in such a manner that the tube lamp 30 is mounted between the two sockets 102 by mounting the two bases 6 at the both ends of the tube lamp 30 to the two sockets 102 mounted at the both ends of the longitudinal direction.

Figure 13:
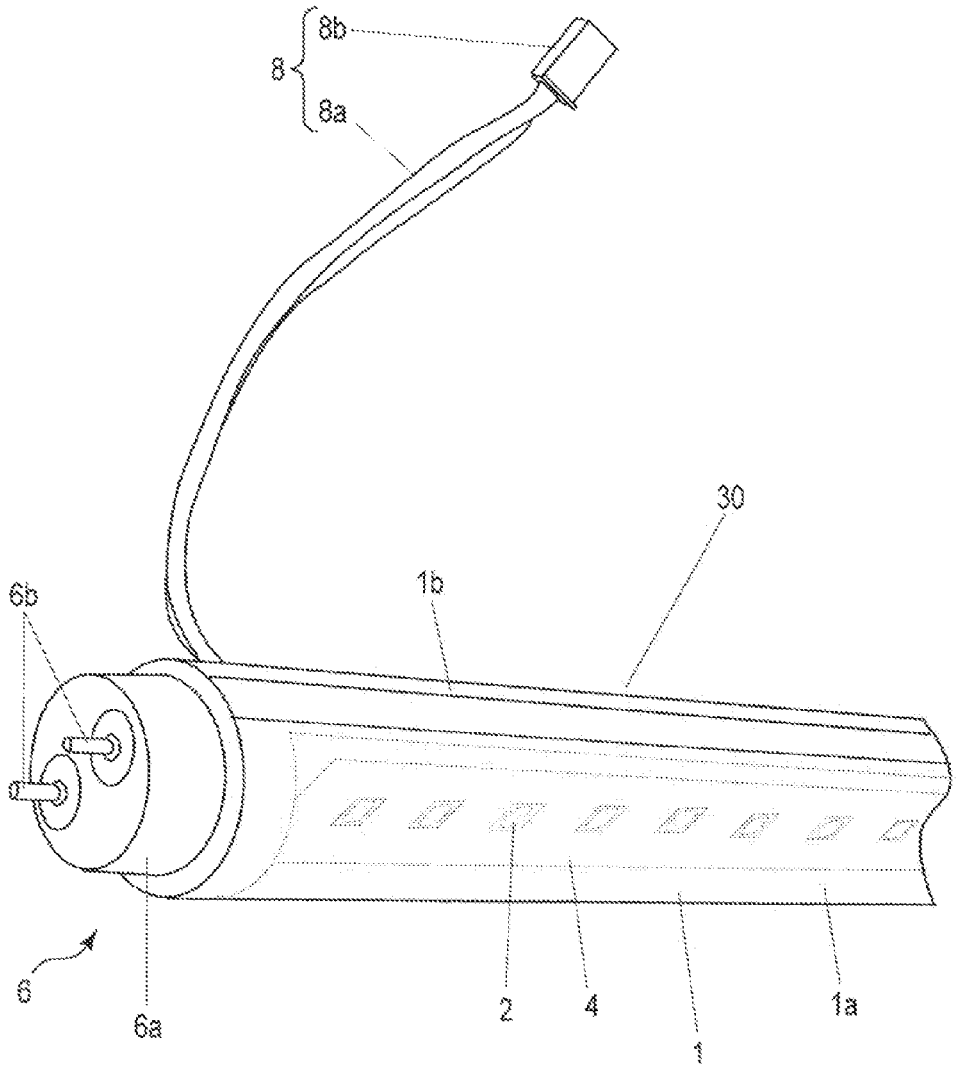
FIG. 13 is a partly enlarged perceptive view of an end portion of the tube lamp in FIG. 10 on the power feeding side.
Figure 14:
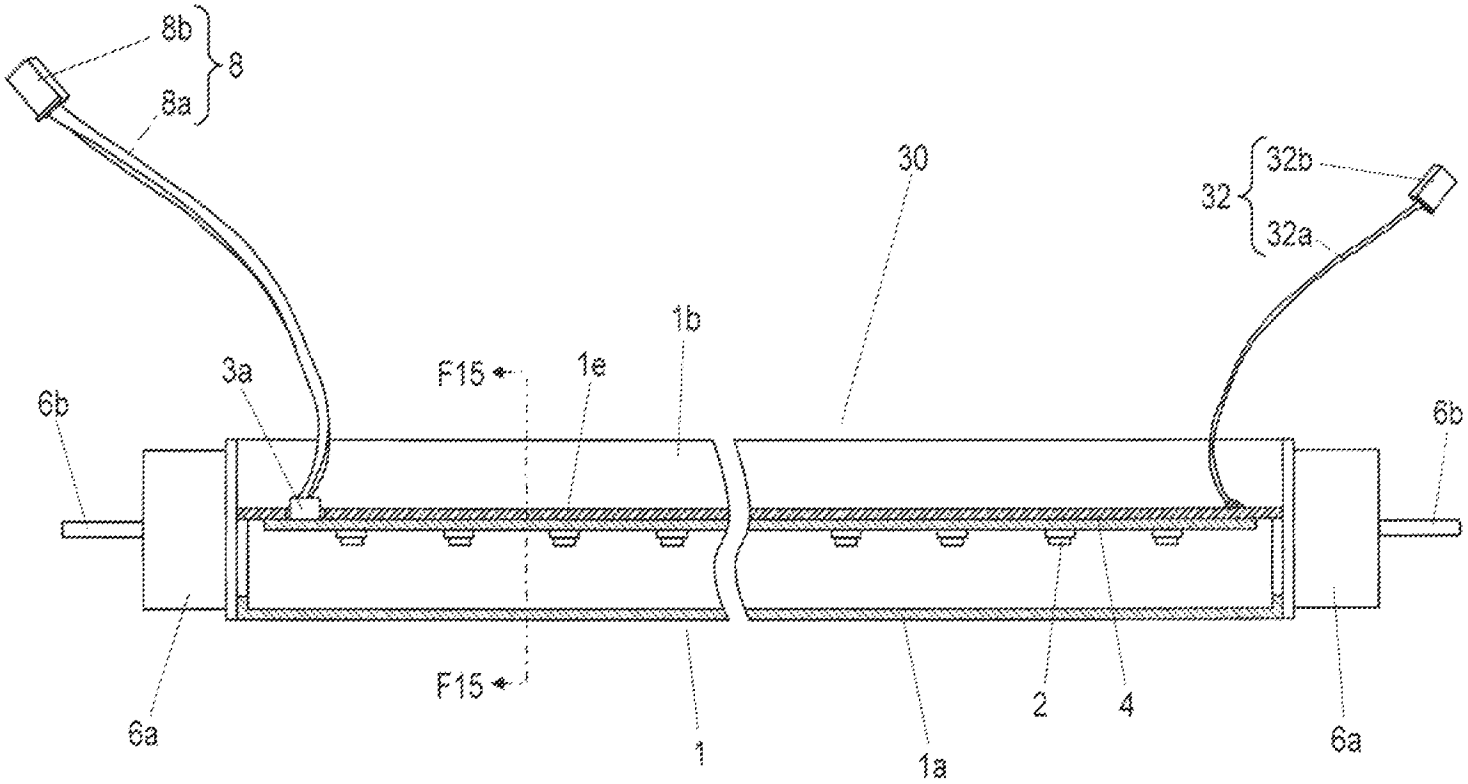
FIG. 14 is a cross-sectional view of the tube lamp in FIG. 10 taken along the tube axis thereof.
Figure 15:
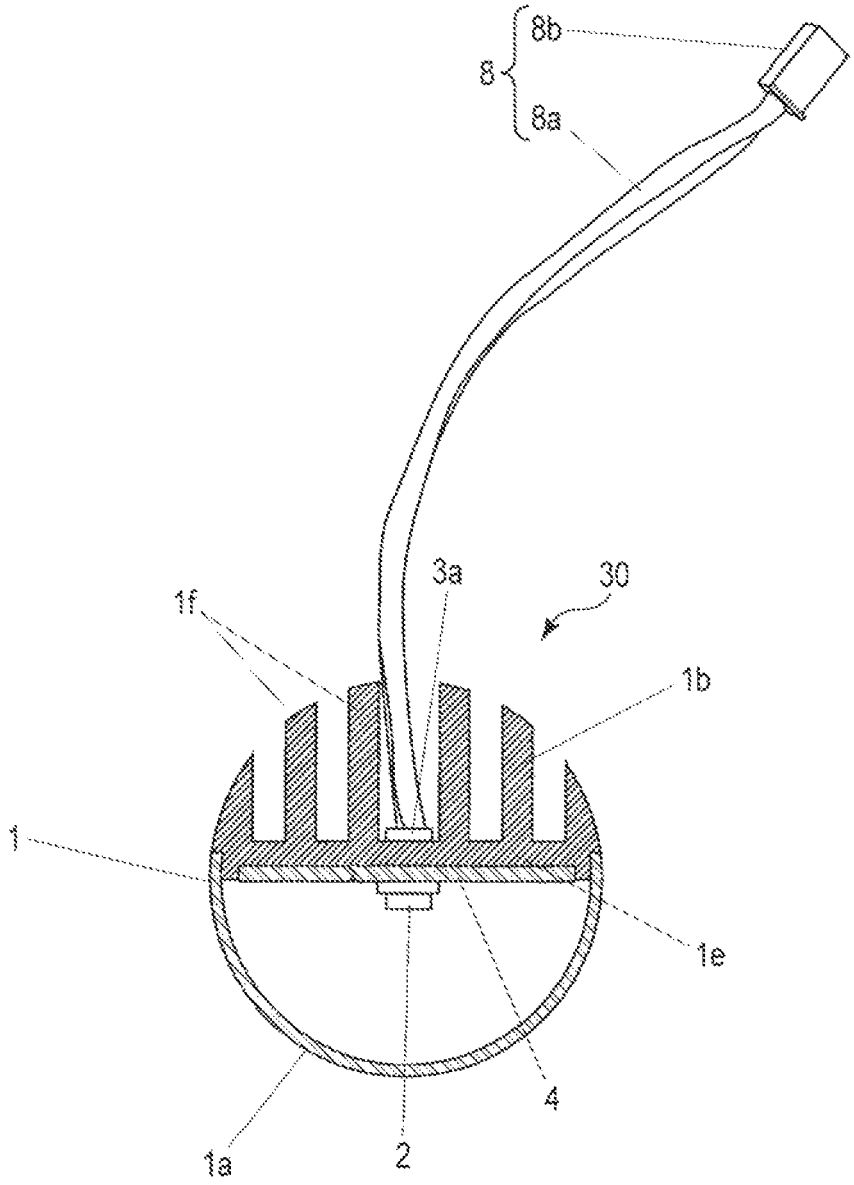
FIG. 15 is a cross-sectional view taken along the line F15-F15 in FIG. 14.

As illustrated in FIG. 13 to FIG. 15, the tube lamp 30 of this embodiment includes the same dimensions and outlines as the existing straight tube fluorescent lamp. More specifically, the tube lamp 30 has the same dimensions and the outline as the straight fluorescent lamp of 40 W. The tube lamp 30 also has the substrates 4 on which the plurality of LEDs 2 are mounted in the lamp body 1 being elongated and having a substantially cylindrical shape in appearance, the two bases 6 at the both ends of the lamp body 1, and the feeding unit 8 and a grounding portion 32 on the lamp body 1.

The lamp body 1 includes a semi-cylindrical translucent cover 1*a* and a semi-cylindrical thermal radiating unit 1*b*. The thermal radiating unit 1*b* is formed of an aluminum material by an extruded molding, and includes a plurality of the thermal radiating fins 1*f* so as to extend upright in the longitudinal direction from the back side of the mounting base 1*e* where the substrates 4 having the LEDs 2 mounted thereon is mounted. The cover 1*a* is mounted on the mounting base 1*e* of the thermal radiating unit 1*b* on the opening side thereof so as to be fitted thereto, and defines a substantially cylindrical outline in cooperation with the thermal radiating unit 1*b*.

Adhered to the front side of the mounting base 1*e* of the thermal radiating unit 1*b* are the elongated substrates 4 having a plurality of LEDs 2 mounted thereon. The substrates 4 are formed into a substantially rectangular shape and, more specifically, four of the substrates 4 are mounted on the mounting base 1*e* of the thermal radiating unit 1*b* in line in the longitudinal direction so that the back sides thereof come into tight contact therewith.

The substrate 4 is formed of a flat plate formed of glass epoxy resin which is an insulating material, and a wiring pattern formed of cooper foil is applied on the front surface side. Also, a resist layer is applied as needed. When the insulating material is used as the material of the substrate 4, ceramics materials or synthetic resin materials may be applied. In addition, when the metal is employed, it is preferable to apply materials having desirable thermal conductivity and superior in thermal radiating properties like aluminum or the like.

The light-emitting elements of the embodiment are the LEDs and a surface-mounted LED package. Schematically, the light-emitting element includes an LED chip disposed on a main body formed of ceramics and a translucent resin for molding such as epoxy-based resin or silicone resin for sealing the LED chip.

The LED chip is a blue LED chip emitting blue light. The translucent resin is mixed with phosphor, and yellow phosphor which emits yellowish light which is in a compensating relationship with the blue light in order to allow emission of white light.

The LEDs 2 may be configured by mounting LED chips directly on the substrates 4, or by mounting bombshell-shaped LEDs thereon. The method or the form of mounting the LEDs is not specifically limited. In the embodiment, four each of the LEDs 2 are mounted linearly along the longitudinal direction on one of the substrates 4.

The bases 6 are, for example, a G13-type base, and are configured to be mountable on the sockets 102 of the luminaire 300 where the existing straight fluorescent lamp is mounted, and are securely provided at the both ends of the lamp body 1. The bases 6 each include a pair of the pins 6*b* so as to project integrally from the bottom of the caps 6*a*. The bases 6 are formed of a metal, and the pair of pins 6*b* are configured to be electrically insulated. The pins 6*b* are not electrically connected to the LEDs 2.

In other words, the bases 6 are electrically opened, and even when power is supplied to the pins 6*b*, the electric current does not flow to the pins 6*b*. Therefore, as described later, when the bases 6 are connected to the sockets 102 of the apparatus body 100 of the luminaire 300, electrical conduction does not occur, and the function to support the tube lamp 30 by the apparatus body 100 is achieved.

The pins 6*b* may be formed of an insulating material or may be coated with an insulating material. In this case, the double safety is secured coupled with the fact that the pair of pins 6*b* are configured to be in the electrically insulated state.

The feeding unit 8 is connected to the power-supply side, that is, the apparatus body 100 side, and has a function to supply the electric power to the LEDs 2 through the substrates 4. The feeding unit 8 of this embodiment includes the connector 8*b* and the feeding wire 8*a* having the connector 8*b* at one end thereof, and is disposed so as to lean on one side of the lamp body 1 in the longitudinal direction (left end in FIG. 14, for example).

The connector 8*b* is provided at the distal end of the feeding wire 8*a*, is formed of a synthetic resin material, and is configured to be connected electrically and mechanically to the connector 104*b* provided at the distal end of the connecting wire 104*a* described later led out from the apparatus body 100 side.

For example, as illustrated in FIG. 14, provided in the vicinity of one end (the left end) on the back side of the substrates 4 is the connectors 3*a* electrically connected to the wiring pattern on the substrates 4, and electrically connected to the LEDs 2. The connectors 3*a* pass through a through hole formed on the mounting base 1*e* of the thermal radiating unit 1*b* and project upward from the upper side of the mounting base 1*e*. A proximal end of the feeding wire 8*a* of the feeding unit 8 is firmly connected to the connectors 3*a*.

Part of the feeding wire 8*a* may be fixed to the lamp body 1 by a tensile force stopper, not illustrated, here. Accordingly, direct application of the stress to be applied to the feeding wire 8*a* on the connecting portion with respect to the connectors 3*a* is avoided. The connector 8*b* of the feeding unit 8 may be provided by fixing directly to the back side of the substrates 4 without providing the feeding wire 8*a*. In this case, the feeding unit 8 is configured of the connector 8*b*.

The grounding portion 32 is provided so that the metallic thermal radiating unit 1*b* of the lamp body 1 is grounded to an earth terminal of the terminal bed 110 provided on the apparatus body 100. The grounding portion 32 is provided so as to lean on the other side (right end in FIG. 14) of the lamp body 1. The grounding portion 32 on the lamp body 1 side includes a grounding wire 32*a* and a connector 32*b* attached to the distal end of the grounding wire 32*a*. The proximal end portion of the grounding wire 32*a* is fixed by a fixing device such as a screw to the mounting base 1*e* of the thermal radiating unit 1*b*. Also, the grounding wire 32*a* may be fixed to the lamp body 1 by a tensile force stopper, not illustrated.

The connector 32*b* is provided at the distal end of the grinding wire 32*a*, is formed of a synthetic resin material, and is configured to be connected to the connector 112*b* provided at the distal end of the grounding wire 112*a* led out from the apparatus body 100 side, described later. The grounding wire 32*a* and the connector 32*b* on the lamp body 1 side, and the grounding wire 112*a* and the connector 112*b* on the apparatus body 100 side function, as grounding wires as a whole, and electrically and mechanically connect the lamp body 1 to the apparatus body 100.

For example, as illustrated in FIG. 9 and FIG. 10, the apparatus body 100 is formed into a box shape having an opening portion opened on a lower side, and includes the sockets 102 mounted at the both ends thereof, the lighting apparatus 108 and the terminal bed 110 stored in the apparatus body 100, and a reflecting panel 120.

The sockets 102 are provided with a feed terminal connecting the two pins 6*b* of the bases 6 at the both ends of the tube lamp 30. However, the feed terminal of the sockets 102 is not connected to the bases 6 of the tube lamp 30 electrically, and is opened electrically.

The lighting apparatus 108 is connected to a commercial AC power source AC, and generates a DC output upon reception of the commercial AC power source AC. The lighting device 108 is configured by connecting a smoothing capacitor between the output terminals of a full-wave rectifying circuit and connecting a DC voltage converting circuit and current detecting means to the smoothing capacitor.

The connecting wire 104*a* is led out from the lighting apparatus 108, and the connector 104*b* is provided at a distal end of the connecting wire 104*a* The connector 104*b* is configured to be electrically and mechanically connected with respect to the connector 8*b* of the feeding unit 8 on the lamp body 1 side.

The power supply wires and earth wires, not illustrated, are connected to the terminal bed 110 from the outside of the apparatus body 100. The lighting apparatus 103 is connected to the terminal bed 110 via the lead wire. In addition, the grounding portion 32 on the lamp body 1 side is electrically connected to the terminal bed 110 via the grounding wire 112*a* and the connector 112*b*.

More specifically, the connector 112*b* is connected to the connector 32*b* of the grounding portion 32, and the proximal end of the grounding wire 112*a* having the connector 112*b* attached to the distal end thereof is connected to the apparatus body 100 by screwing or the like. Since the apparatus body 100 is electrically connected to the earth terminal of the terminal bed 110, the lamp body 1 is configured to be grounded thereby.

Figure 11:
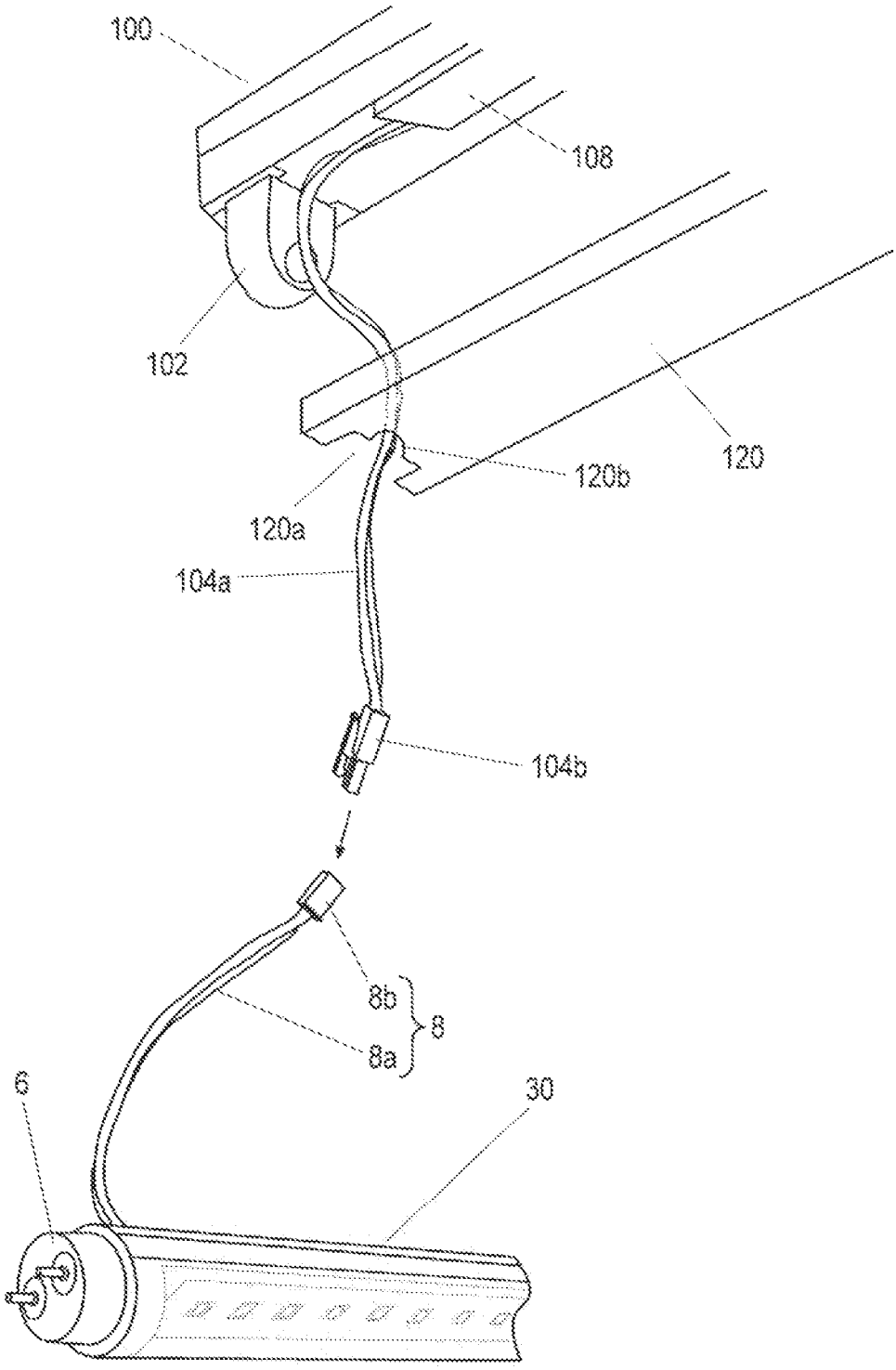
FIG. 11 is a perspective view for explaining a connecting state of a feeding unit or the luminaire in FIG. 10.
Figure 12:
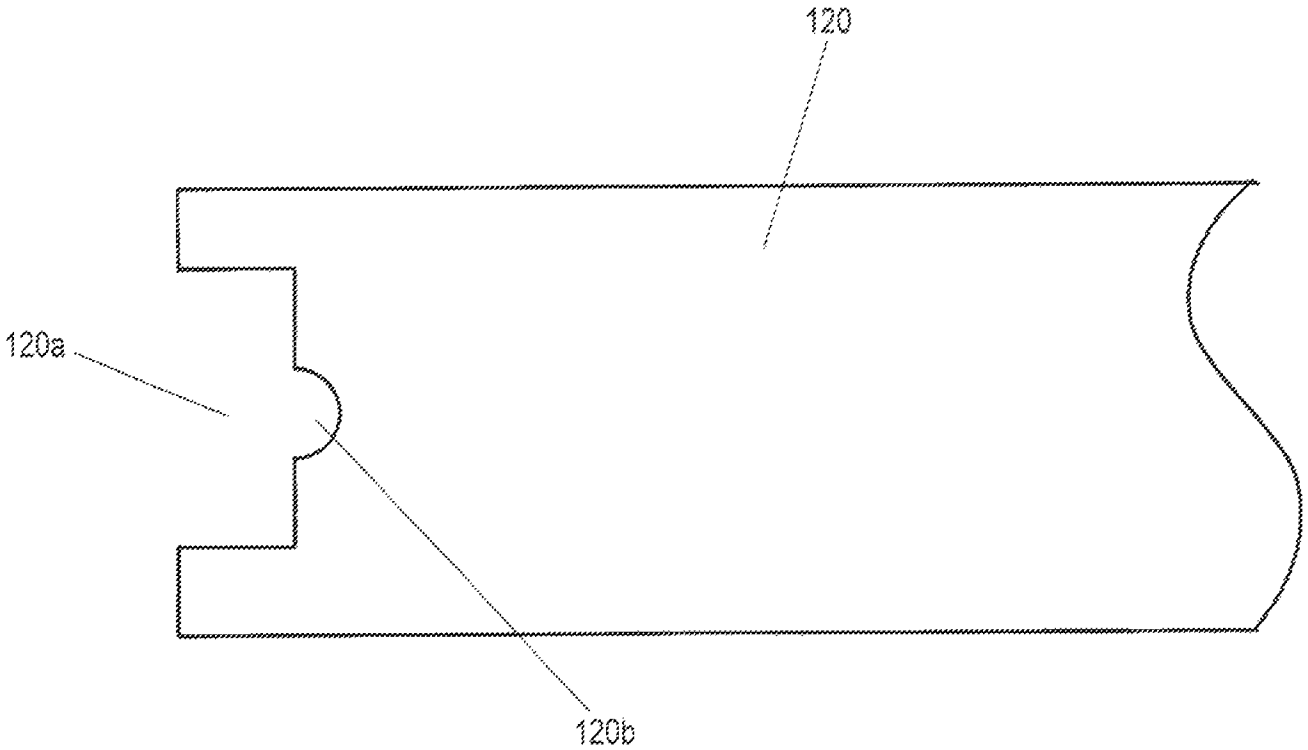
FIG. 12 is a partly enlarged plan view of a principal portion of a reflecting panel integrated in the luminaire in FIG. 10.

As illustrated in FIG. 11 and FIG. 12, the reflecting panel 120 is mounted so as to cover the opening portion on the lower surface side of the apparatus body 100, Rectangular notches 120*a* allowing fitting of the sockets 102 are formed respectively at both ends of the reflecting panel 120 in the longitudinal direction, Also, U-shaped insertion portions 120*b* and 120*c* continuing to the notches 120*a* respectively are formed at edge portions on the sides where the notches 120*a* face the sockets 102.

In the luminaire 300 configured in this manner, referring mainly to FIG. 10 to FIG. 12, a method or mounting the tube lamp 30 so the apparatus body 100 will be described. This embodiment is premised on a so-called renewal, that is, the straight tube fluorescent lamp mounted on the existing luminaire is replaced by the tube lamp 30.

First of all, the straight tube fluorescent lamp, not illustrated is removed from the existing apparatus body 100, and the reflecting panel 120 is removed. Subsequently, the lighting apparatus, not illustrated, for performing the lighting control of the existing straight tube fluorescent lamp is removed, and the lighting apparatus 108 for performing the lighting control or the tube lamp 30 is mounted within the apparatus body 100. At this time, the lead wire drawn from the lighting apparatus 108 is connected to the terminal bed 110. Then, the U-shaped insertion portions 120*b* and 120*c* are formed at the both ends of the reflecting panel 120 in the longitudinal direction by using the tool or the like.

Subsequently, the connecting wire 104*a* connected to the lighting apparatus 108 is inserted and disposed so as to be led out from the one insertion portion 120*b* of reflecting panel 120 and the grounding wire 112*a* mounted on the apparatus body 100 in electric conduction is inserted and disposed so as to be led out from the other insertion portion 120*c* of the reflecting panel 120, whereby the reflecting panel 120 is mounted on the apparatus body 100.

Subsequently, the connector 8*b* of the feeding unit 8 on the lamp body 1 side is connected to the connector 104*b* provided on the connecting wire 104*a* on the apparatus body 100 side, and the connector 32*b* of the grounding portion 32 on the lamp body 1 side is connected to the connector 112*b* mounted at the distal end of the grounding wire 112*a* on the apparatus body 100 side, Accordingly, the tube lamp 30 is suspended and supported by the apparatus body 100 via the feeding wire and the grounding wire connected to the both ends thereof.

In addition, subsequently, the bases 6 at the both ends of the tube lamp 30 are mounted on the sockets 102. Then, mounting of the tube lamp 30 with respect to the apparatus body 100 is completed. Accordingly, power is supplied from the feeding unit 8 to the tube lamp 30 and the tube lamp 30 is supported by the sockets 102 so that the mounted state can be held. Depending on the state of deterioration of the sockets 102, the sockets 102 may be replaced simultaneously with the replacement of the tube lamp 30.

Figure 16:
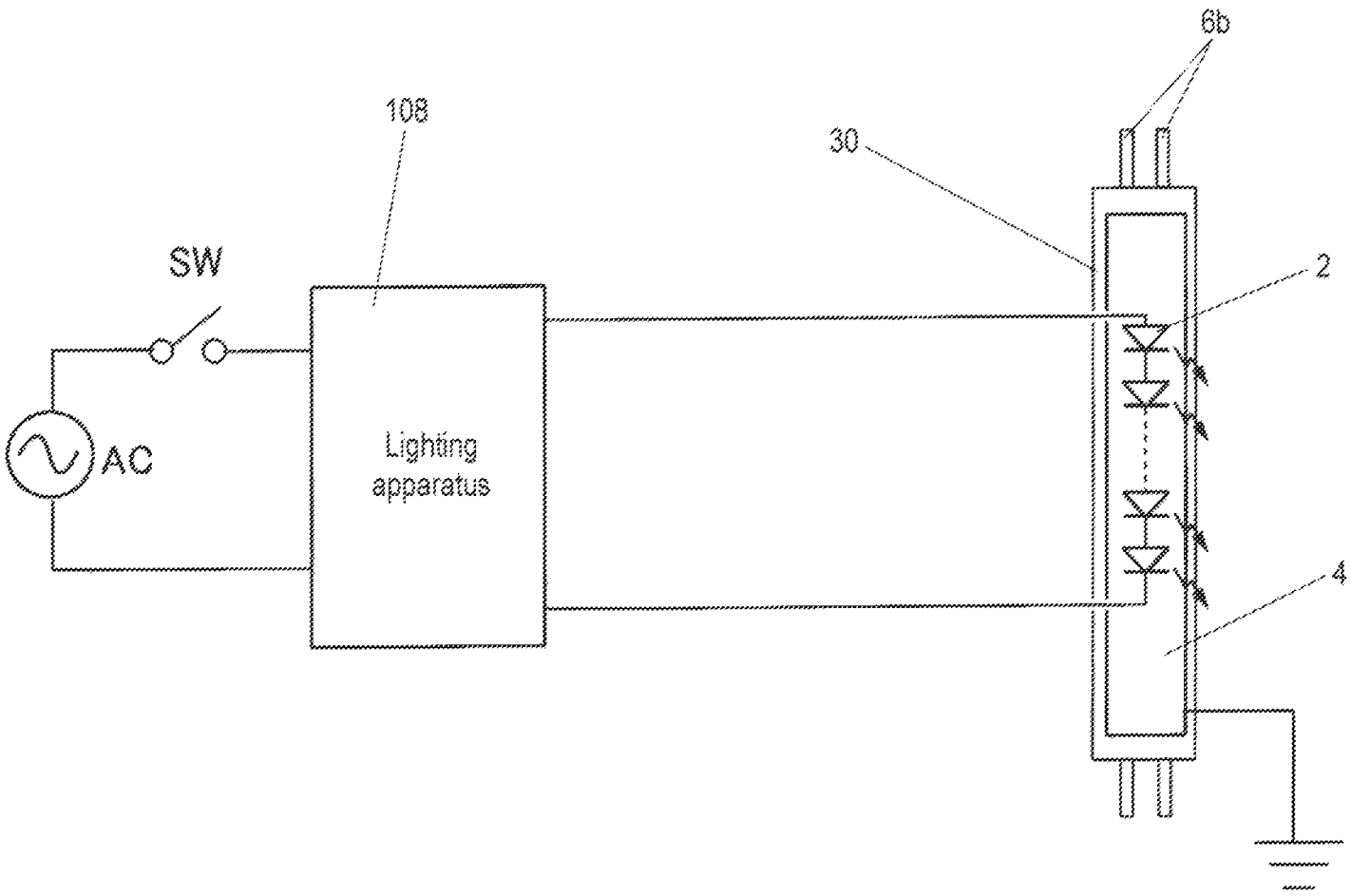
FIG. 16 is a circuit diagram of the luminaire in FIG. 8.

As illustrated in a connecting diagram in FIG. 16, the lighting apparatus 108 is connected to the commercial AC power supply AC, and the output from the lighting apparatus 108 is supplied to the LEDs 2. As is clear from FIG. 16, there is no component electrically connected to the pins 6*b* projecting from the both ends of the lamp body 1, and no power is supplied to the lamp body 1 via the bases 6.

In the luminaire 300 configured as described above, when the power is supplied to the lighting apparatus 108, through the connecting wire 104*a*, the connector 104*b*, the connector 8*b*, the feeding wire 8*a*, and the substrates 4 the plurality of LEDs 2 are energised and the respective LEDs 2 are lit. The light emitted from the LEDs 2 pass through the cover 1*a*, and is radiated downward whereby a predetermined range is illuminated.

In this case, energisation of the tube lamp 30 is performed via the feeding unit 8, and the bases 6 are not energized via the sockets 102. Therefore, even though the sockets 102 are in the deteriorated state, a problem that the electrical connection becomes unstable is avoided. Therefore, the stability of the electric connection can be secured.

Also, the connecting wire 104*a* at the power source side, that is, for connecting the apparatus body 100 and the feeding unit 6 of the lamp body 1 is led out from the insertion portion 120*b* formed continuously with the notches 120*a* of the reflecting panel 120 for fitting the sockets 102. In other words, the connecting wire 104*a* led out from the apparatus body 100 is wired along the one socket 102.

Therefore, the connecting wire 104*a*, the connector 104*b*, the connector 8*b*, and the feeding wire 8*a* which constitute the feeding wire 9 are hidden inside the socket 102 and hence do not show up, and hence good appearance is achieved. In particular, since the connecting wire 104*a*, the connector 104*b*, the connector 8*b* and the feeding wire 8*a* are arranged on the back side of the tube lamp 30, these members do not become an obstacle of light emitted from the LEDs 2.

In addition, the connecting wires 104*a*, 8*b* formed of a synthetic resin material are hidden on the back side of the tube lamp 30, the dose of the UV-ray radiation may be reduced by a long term use of the tube lamp 30, so that the deterioration of the connector due to the UV ray can be inhibited. The effects obtained by the insertion portion 120*b* described above may be the same for the insertion portion 120*c* on the grounding portion side as well.

Incidentally, when the existing straight fluorescent lamp is replaced by the tube lamp 30, it is imagined that the apparatus body 100 has been used already for a long time to some extent. In other words, when the apparatus body 100 for mounting the tube lamp 30 is used for a long time, there is a probability of deterioration of the sockets 102 due to the influence of, in particular, heat or UV-ray. Therefore, when the tube lamp 30 is mounted on the sockets 102 of the apparatus body 100 deteriorated in this manner, the bases 6 of the tube lamp 30 may come apart from the sockets 102 due to vibrations or the like, and the tube lamp 30 may drop.

However, even though the bases 6 portion of the tube lamp 30 come apart from the sockets 102, one end of the tube lamp 30 is connected by the feeding unit 8, whereby the dropping may be prevented. In addition, since the grounding portion 32 is connected to the other end of the tube lamp 30, the both end sides thereof are supported in cooperation with the feeding unit 8, and the further safety may be secured. The feeding wire 8*a* of the feeding unit 8 and the grounding wire 32*a* of the grounding portion 32 are adjusted to the substantially same length.

Since the feeding unit 8 is arranged in the vicinity of the position near the end portion of the lamp body 1 of the tube lamp 30, it does not show up in appearance, and then the feeding wire 8*a* can be reduced.

Since the grounding portion 32 is connected to the thermal radiating unit 11*b* of the lamp body, even though the insulating properties of the substrates 4 where the LEDs 2 are mounted are deteriorated whereby the insulating properties between the substrates 4 and the thermal radiating unit 1*b* and the current is leaked to the thermal radiating unit 1*b*, risk of the electric shock may be prevented at the time of the maintenance such as cleaning or the replacement of the tube lamp 30 since the thermal radiating unit 1*b* is grounded.

Figure 17:
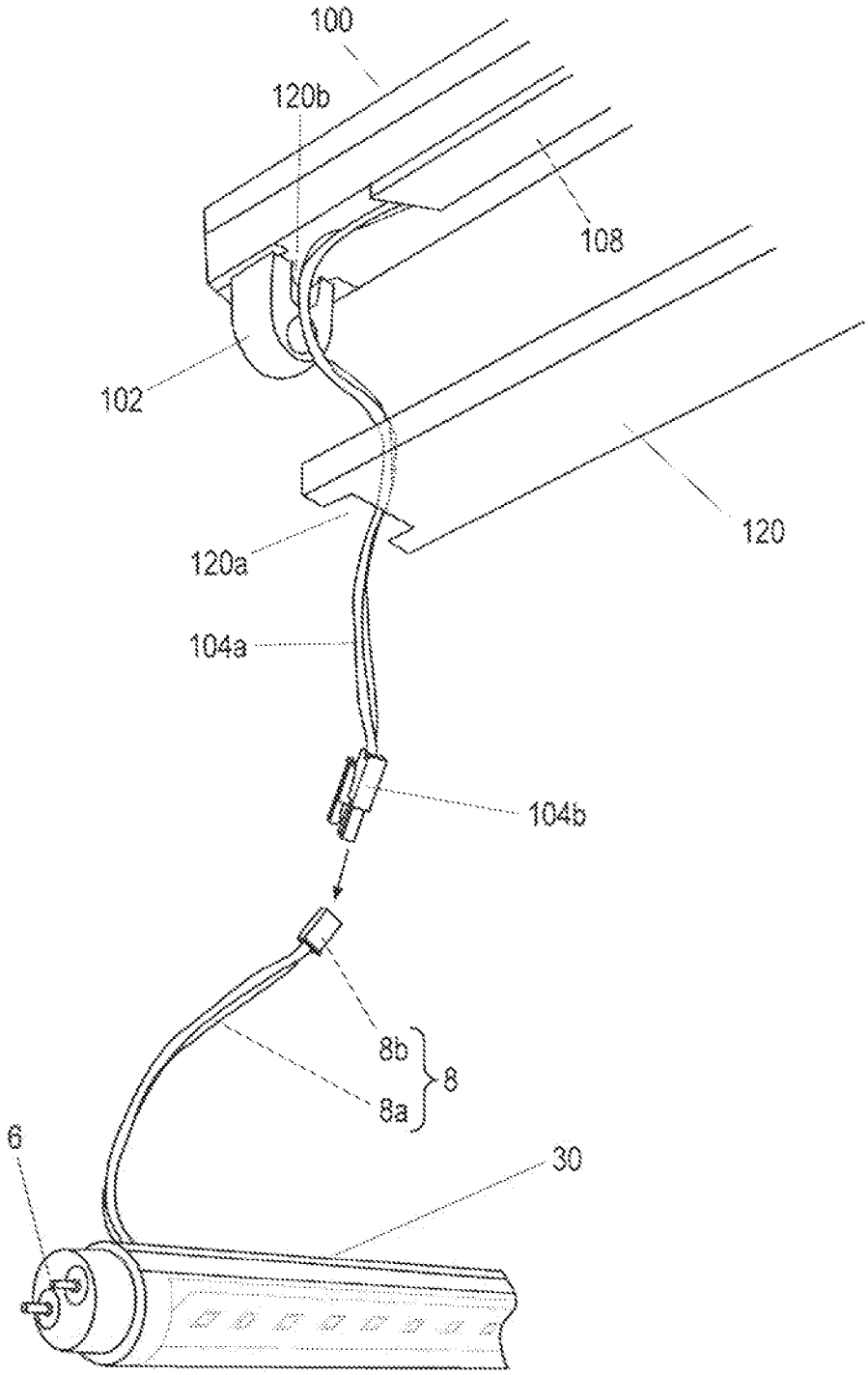
FIG. 17 is a partly enlarged perspective view illustrating the structure of a principal portion of a luminaire according to a fourth embodiment.

FIG. 17 is a partly enlarged perspective view illustrating a principal portion of the luminaire according to a fourth embodiment. For reference, here, the components which function in the same manner as the luminaire of the third embodiment described above are designated by the same reference signs, and the detailed description is omitted.

This embodiment is characterised in that the insertion portion 120*b* for inserting the connecting wire 104*a* led out from the apparatus body 100 side is provided on the sockets 102 instead of the reflecting panel 120. The insertion portion 120*b* is configured by a depression formed inside the sockets 102. This depression is formed into a substantially semi-cylindrical shape so as to allow the passage of the connecting wire 104*a* connected to the lighting apparatus 108 and, more specifically, forms the insertion portion 120*b* with the rectangular notches 120*a* formed on the reflecting panel 120.

In the case of this embodiment, it is accommodated by replacing the existing socket by the sockets 102 formed with the insertion portion 120*b*, or by machining the insertion portion 120*b* on the existing socket. Here, although illustration and description are omitted, the insertion portion 120*c* configured to allow insertion of the grounding wire 112*a* led from the apparatus body 100 is also formed inside the socket 102.

As described above, according to the embodiment, the same effect as the third embodiment described above is achieved. In other cords, in this embodiment, the feeding wire and the grounding wire can be wired along the sockets 102, and hence the lead wire and the connectors are not seen from, the front side of the luminaire, so that the appearance is improved.

Referring now to FIG. 18 to FIG. 25, a luminaire 500 according to a fifth embodiment will be described. The components which function as those in the first to fourth embodiments are designated by the same reference signs, and detailed description may be omitted.

Figure 18:
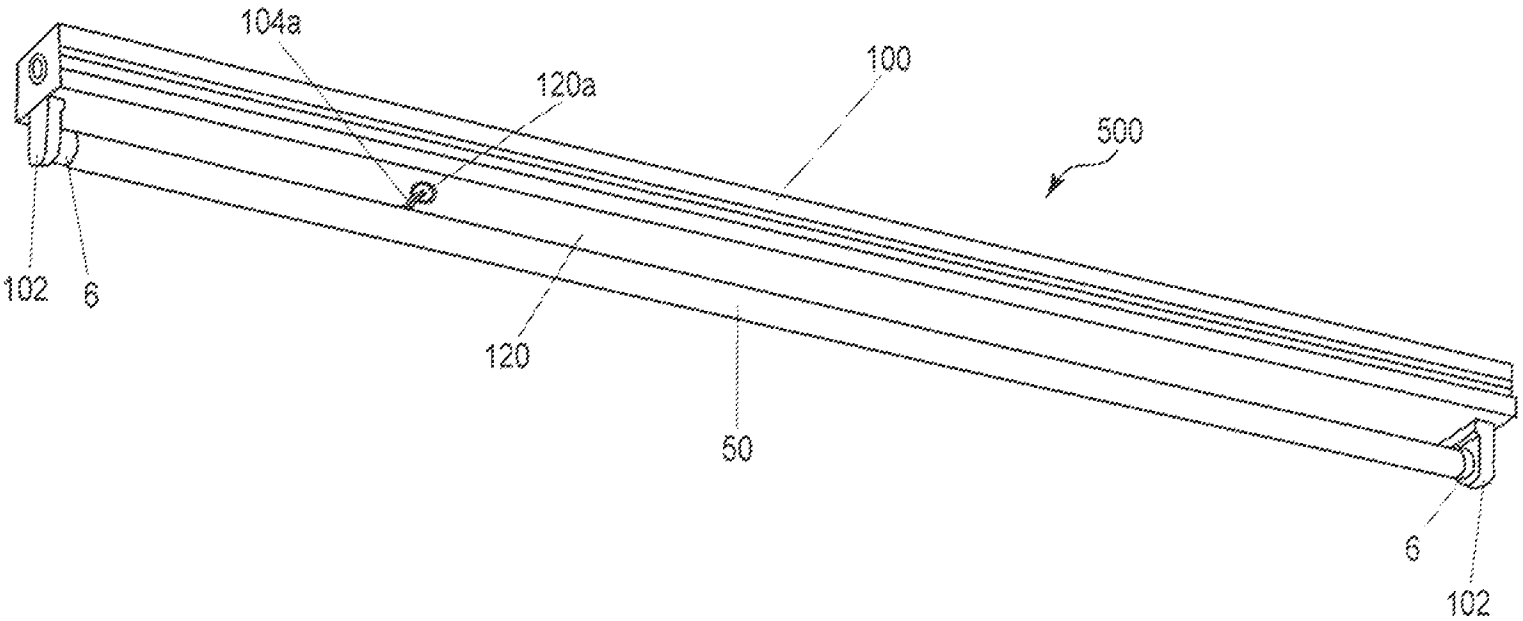
FIG. 18 is an apparent perspective view illustrating a luminaire according to a fifth embodiment.
Figure 19:
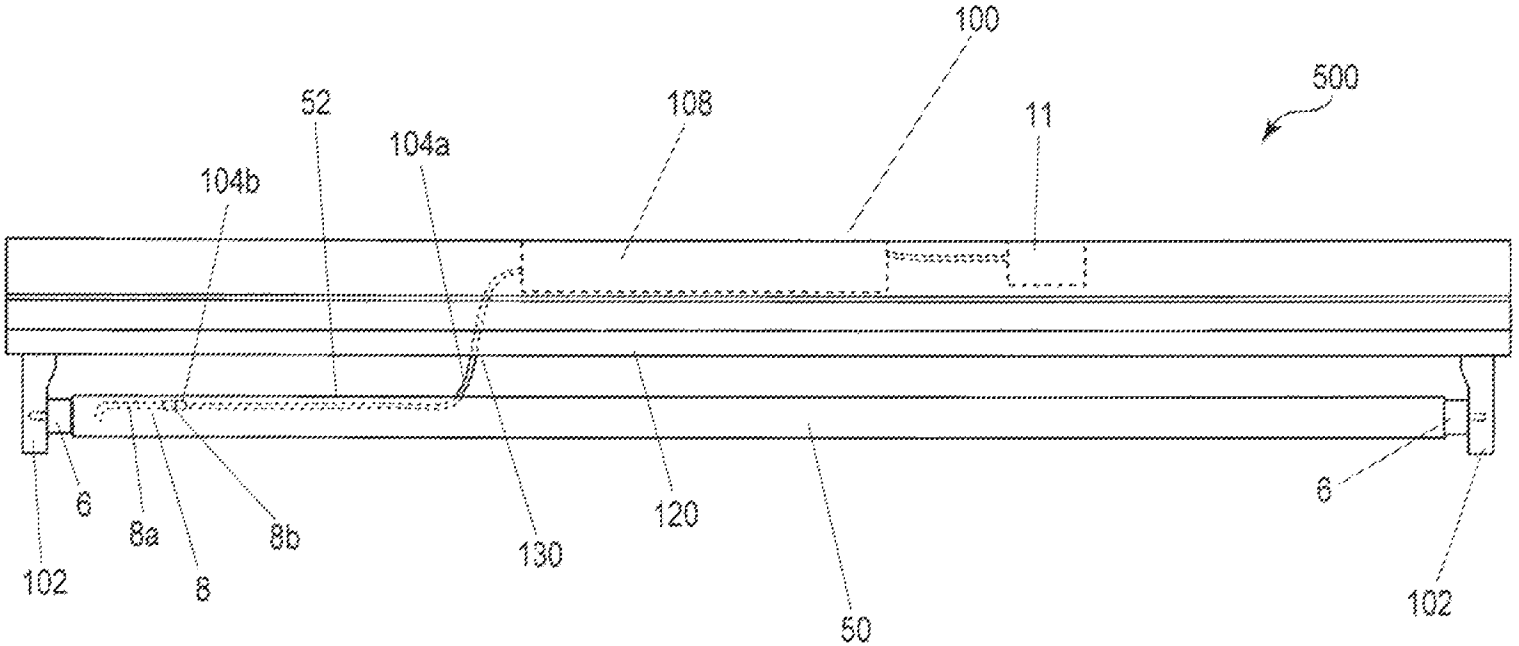
FIG. 19 is a side view of the luminaire in FIG. 18 when viewed from a side.

FIG. 18 illustrates an appearance perspective view of the luminaire 500 of this embodiment, and FIG. 19 illustrates a side view of the luminaire 500 viewed from the side. The luminaire 500 includes the apparatus body 100 to be installed on the ceiling surface or the like of the building and a tube lamp 50 to be mounted on the apparatus body 100.

The apparatus body 100, in which the existing straight fluorescent lamp has been mounted, has a structure which allows the straight fluorescent lamp to be replaced by the tube lamp 50. In other words, the apparatus body 100 is configured in such a manner that the tube leap 50 is mounted between the two sockets 102 by connecting the two bases 6 at the both ends of the tube lamp 50 to the two sockets 102 mounted at the both ends in the longitudinal direction.

As illustrated in FIG. 20 to FIG. 23, the tube lamp 50 of this embodiment includes the same dimensions and outlines as the existing straight tube fluorescent lamp. More specifically, the tube lamp 30 has the same dimensions and the outline as the straight fluorescent lamp of 40 W. The tube lamp 50 also has the substrate 4 on which the plurality of LEDs 2 are mounted in the lamp body 1 being elongated and having a substantially cylindrical shape, the two bases 6 at the both ends of the lamp body 1, and the feeding unit 8 on the lamp body 1.

The lamp body 1 is formed by extrusion of the translucent synthetic resin material, includes an outline of substantially cylindrical shape, and has an internal space in which the plurality of the LEDs 2 are arranged. Then, a storage depression 52 having a substantially angular U-shape in cross section and in a groove shape is formed along the longitudinal direction on the back side of the lamp body 1. The storage depression 52 has a function, as a storage portion configured to store the feeding wire and the grounding wire connecting the lamp body 1 and the apparatus body 100.

The thermal radiating unit 1*b* having a rectangular shape elongated along the longitudinal direction is provided in the interior space of the lamp body 1. The thermal radiating unit 1*b* is formed of an aluminum material of the like having superior conductivity.

Adhered to the front side of the thermal radiating unit 1*b* are the elongated substrates 4 having the plurality of LEDs 2 mounted thereon. The substrates 4 are formed into a substantially rectangular shape and, more specifically, four of the substrates 4 are mounted on the thermal radiating unit 1*b* in line in the longitudinal direction so that the back sides thereof come into tight contact therewith.

The substrate 4 is formed of a flat plate formed of glass epoxy resin which is an insulating material, and a wiring pattern formed of copper foil is applied on the side of the front surface. Also, a resist layer is applied as needed. When the insulating material is used as the material of the substrates 4, ceramics materials or synthetic resin materials may be applied. In addition, when the metal is employed, it is preferable to apply materials having desirable thermal conductivity and superior in thermal radiating properties like aluminum or the like.

The light-emitting elements of the embodiment are the LEDs and a surface-mounted LED package. Schematically, the light-emitting element includes an LED chip disposed on a main body formed of ceramics and a translucent resin for molding such as epoxy resin or silicone resin for sealing the LED chip.

The LED chips are blue LED chips emitting blue light. The translucent resin is mixed with phosphor, and yellow phosphor which emits yellowish light which is in a compensating relationship with the blue light is employed in order to allow emission of white light.

The LEDs 2 may be configured by mounting LED chips directly on the substrate 4, or by mounting bombshell-shaped LEDs 2 thereon. The method or the form of mounting the LEDs is not specifically limited. In the embodiment, four each of the LEDs 2 are mounted linearly along the longitudinal direction on one of the substrates 4.

The bases 6 are, for example, a G13-type base, and are configured to be mountable on the sockets 102 of the luminaire 500 where the existing straight fluorescent lamp is mounted, and are securely provided at the both ends of the lamp body 1. The bases 6 each include a pair of the pins 6*b* so as to project integrally from the bottom of the bases 6*a*. The bases 6 are formed of a metal, and the pair of pins 6*b* are configured to be electrically insulated. The pins 6*b* are not electrically connected to the LEDs 2.

In other words, the bases 6 are electrically opened, and even when power is supplied to the pins 6*b*, the electric current does not flow to the pins 6*b*, Therefore, as described later, when the bases 6 are connected, to the sockets 102 of the apparatus body 100 of the luminaire 500, electrical conduction does not occur, and the function to support the tube lamp 50 by the apparatus body 100 simply is achieved.

The pins 6*b* may be formed of an insulating material or may be coated with an insulating material. In this case, the double safety is secured coupled with the fact that the pair of 6*b* are configured to be in the electrically insulated state.

Figure 20:
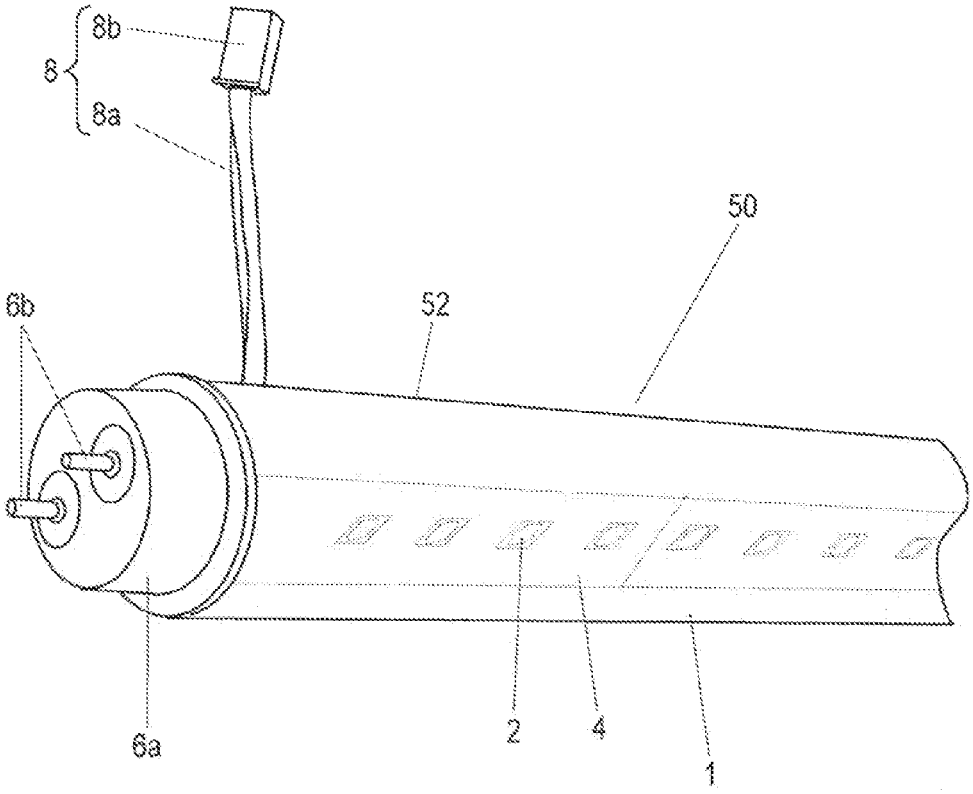
FIG. 20 is a partly enlarged perspective view illustrating a principal portion of the tube lamp of the luminaire in FIG. 18.

The feeding unit 8 is connected to the power supply side, that is, the apparatus body 100 side, and has a function to supply the electric power to the LEDs 2 through the substrates 4, The feeding unit 8 of this embodiment includes the connector 8*b* and the feeding wire 8*a* having the connector 8*b* at one end thereof, and is disposed so as to lean on one side of the lamp body 1 in the longitudinal direction (left end in FIG. 20, for example).

The connector 8*b* is provided of the distal end of the feeding wire 8*a*, is formed of a synthetic resin material, end is configured to be connected electrically and mechanically to the connector 104*b* provided at the distal end of the connecting wire 104*a*, described later, led out from the apparatus body 100 side.

Figure 21:
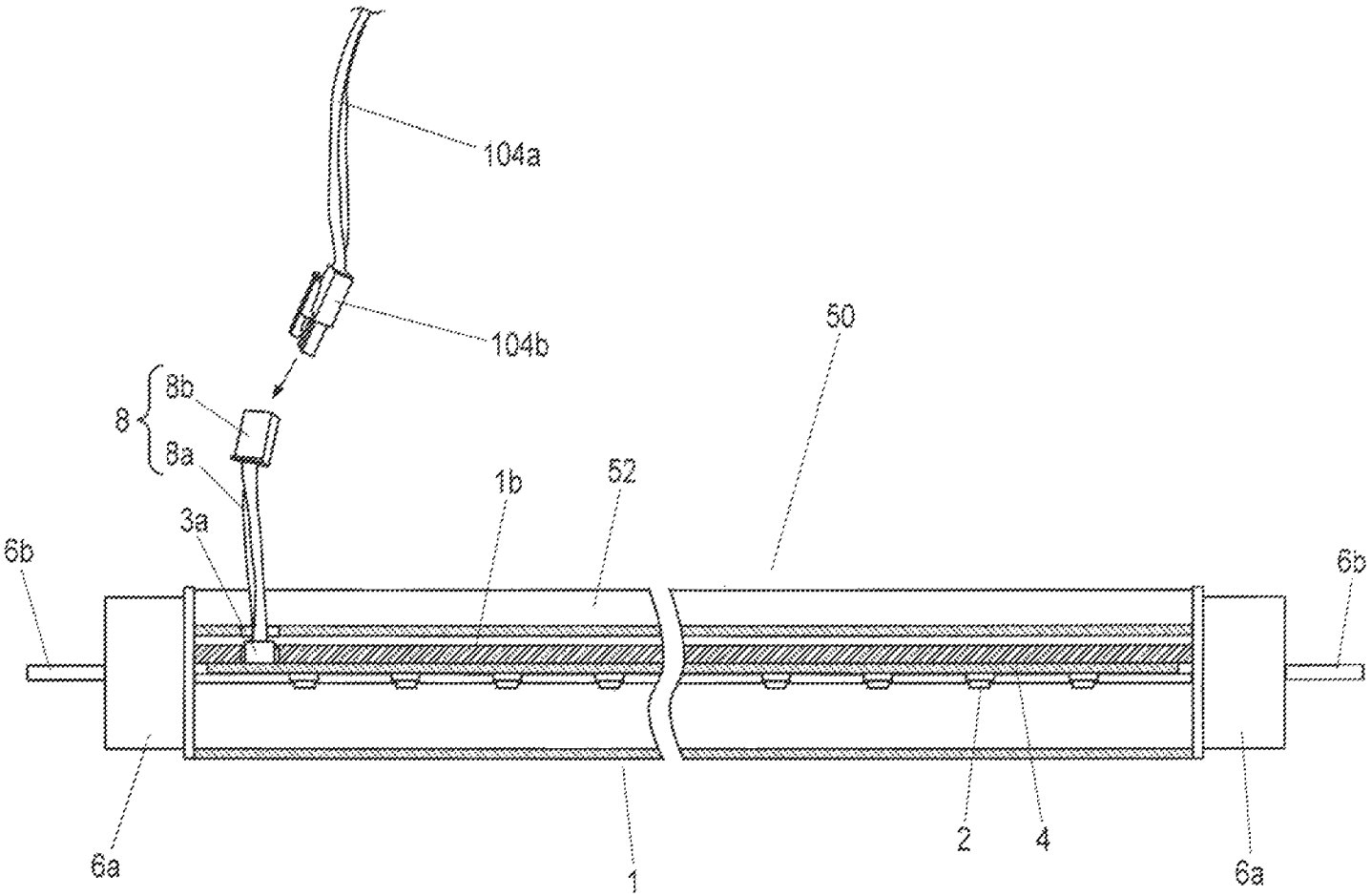
FIG. 21 is a cross-sectional view of the tube lamp in FIG. 20 taken along a tube axis.

For example, as illustrated in FIG. 21, provided in the vicinity of one end (the left end in the drawing) on the back side of the substrate 4 is the connectors 3*a* electrically connected to the wiring pattern on the substrates 4, and electrically connected to the LEDs 2. The connectors 3*a* pass through a through hole formed on the thermal radiating unit 1*b* and project to the back side of the thermal radiating unit 1*b*. A proximal end of the feeding wire 8*a* of the feeding unit 8 is firmly connected to the connectors 3*a*. The feeding wire 8*a* led out from the connectors 3*a* to the back side is led out to the back side of the lamp body 1 through the through hole formed on the bottom of the storage depression 52.

Part of the feeding wire 8*a* may be fixed to the lamp body 1 by a tensile force stopper, not illustrated. Accordingly, direct application of the stress to be applied to the feeding wire 8*a* on the connecting portion with respect to the connectors 3*a* is avoided. Alternatively, instead of providing the tensile force stopper, the connector 8*b* of the feeding unit 8 may be fixed to the storage depression 52. The connector 8*b* of the feeding unit 8 may be provided directly to the back side of the substrates 4 without providing the feeding wire 8*a*. In this case, the feeding unit 8 is configured of the connector 8*b*.

Incidentally, the apparatus body 100 is formed into a box shape having an opening portion opened on a lower side, and includes the sockets 102 mounted at the both ends thereof, the lighting apparatus 108 and the terminal bed 110 stored in the apparatus body 100, and the reflecting panel 120 mounted so as to cover the opening portion on the lower surface side.

The sockets 102 are provided with feed terminals connecting the two pins 6*b* of the bases 6 at the both ends of the tube lamp 50. However, the feed terminal of the sockets 102 is not connected to the bases 6 of the tube lamp 80 electrically, and is opened electrically.

The lighting apparatus 108 is connected to a commercial AC power source AC, and generates a DC output upon reception of the commercial AC power source AC. The lighting device 108 is configured by connecting a smoothing capacitor between the output terminals of a full-wave rectifying circuit, and connecting a DC voltage converting circuit and current detecting means to the smoothing capacitor.

The connecting wire 104*a* is led out from the lighting apparatus 108, and the connector 104*b* is provided at a distal end of the connecting wire 104*a*. The connector 104*b* is configured to be electrically and mechanically connected with respect to the connector 8*b* of the feeding unit 8 on the lamp body 1.

The reflecting panel 120 is formed with the penetrating circular insertion portion 120*a* (FIG. 18) for allowing insertion of the connecting wire 104*a* drawn out from the lighting apparatus 108. The insertion portion 120*a* is disposed with a bush as a wiring protecting material. Also, the insertion portion 120*a* is provided with a tensile force stopper 130 (FIG. 19) for fixing the connecting wire 104*a* to the apparatus body 100.

Figure 22:
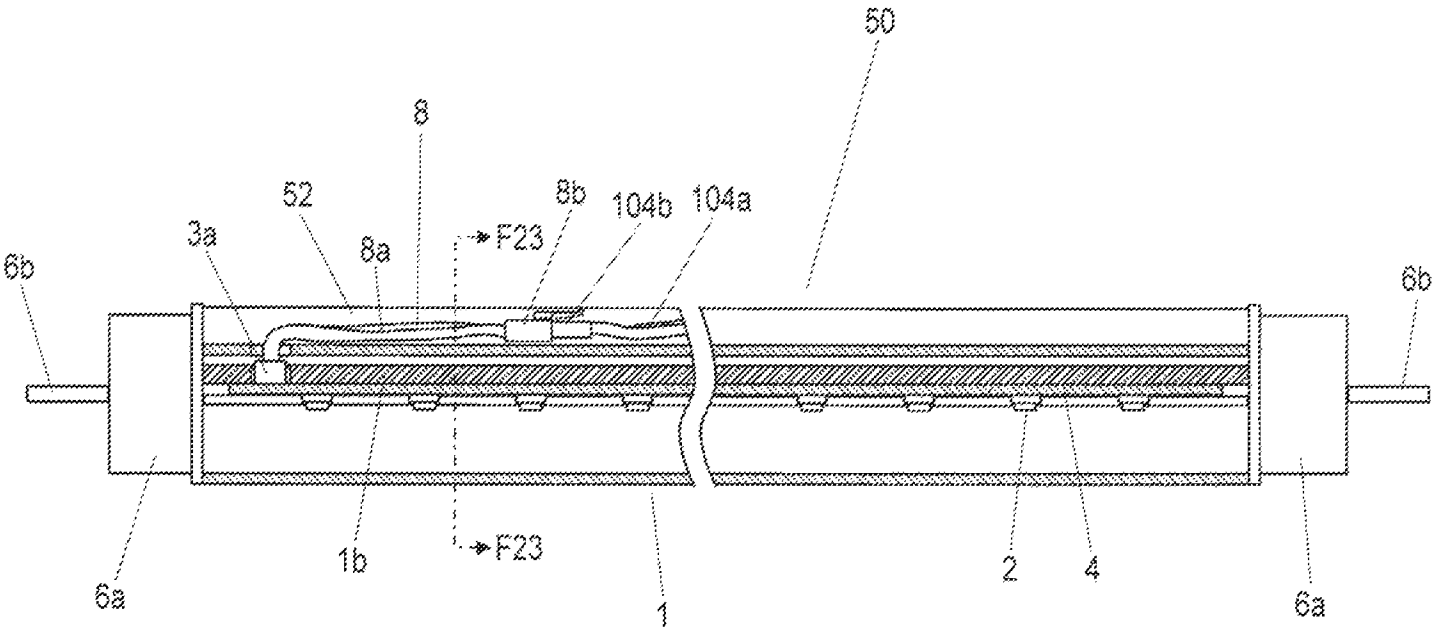
FIG. 22 is a cross-sectional view of the tube lamp in FIG. 21 illustrating a state in which a feed wire of the tube lamp in FIG. 21 is stored in a storage portion.
Figure 23:
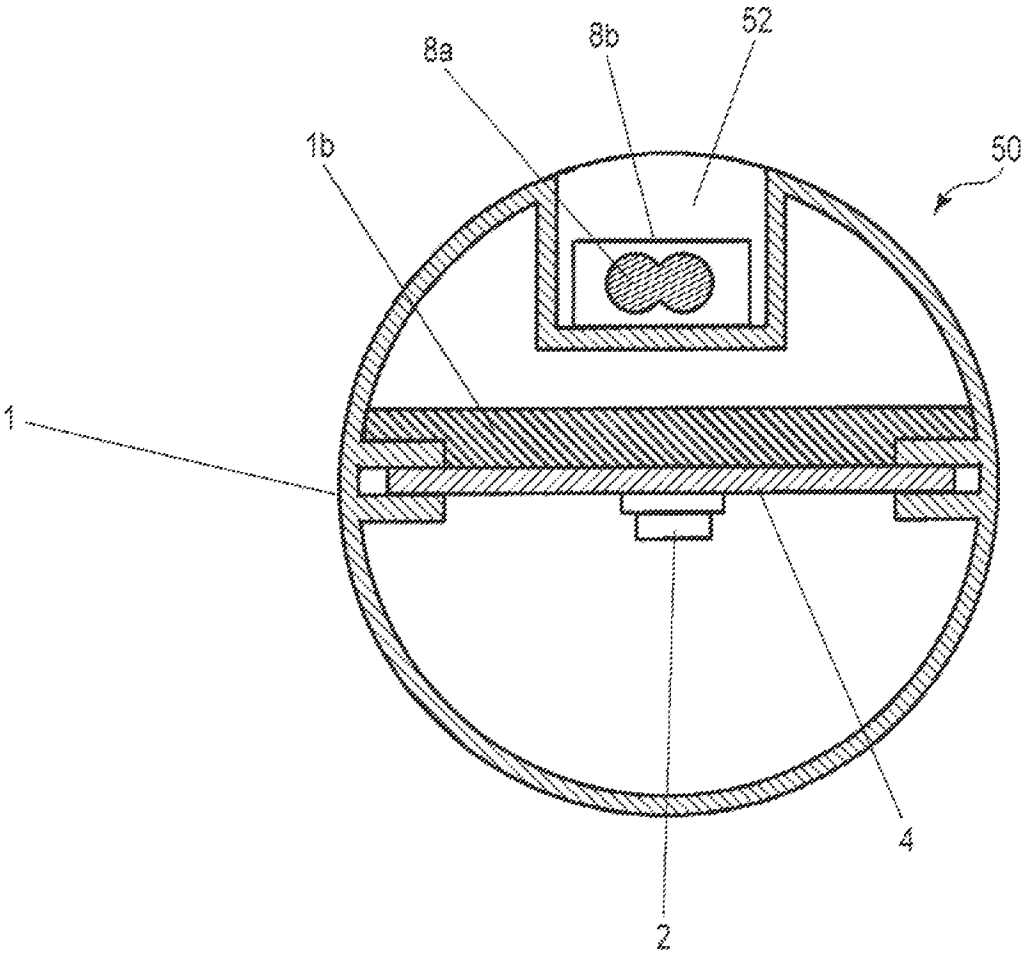
FIG. 23 is a cross-sectional view taken along the line F23-F23 in FIG. 22.

The connecting wire 104*a* and the connector 104*b* passed through the insertion portion 120*a*, and the feeding unit 8 connected to the connector 104*b* are configured to be stored in the storage depression 52 provided on the back side of the lamp body 1. Therefore, the projection or protrusion of the feeding wire or the connector from the outer shell of the lamp body 1 may be reduced, and the wiring process may be performed cohesively. In FIG. 22 and FIG. 23, a state in which the feeding wire 8*a* and the connector 8*b* are stored in the storage depression 52 is illustrated.

The terminal bed 110 is configured to allow connection of the power supply wires and earth wires, not illustrated, from the outside of the apparatus body 100. The lighting apparatus 108 is connected to the terminal bed 110 via the lead wire.

Here, in the luminaire 500, a method of mounting the tube lamp 50 to the apparatus body 100 will be described. This embodiment is premised on a so-called renewal, that is, the straight tube fluorescent lamp mounted on the existing luminaire is replaced by the tube lamp 50.

First of all, the straight tube fluorescent lamp, not illustrated is removed from the existing apparatus body 100, and the reflecting panel 120 is removed. Subsequently, the lighting apparatus, not illustrated, for performing the lighting control of the existing straight tube fluorescent lamp is removed, and the lighting apparatus 108 for performing the lighting control of the tube lamp 50 is mounted within the apparatus body 100. At this time, the lead wire drawn from the lighting apparatus 108 is connected to the terminal bed 110. Also, at this time, the insertion portion 120*a* is formed on the reflecting panel 120 using a tool or the like.

Subsequently, the connecting wire 104*a* connected to the lighting apparatus 108 is passed through the insertion portion 120*a* of the reflecting panel 120, and the reflecting panel 12 is mounted to the apparatus body 100. In this state, the connecting wire 104*a* and the connector 104*b* of the connecting portion 104 are brought into a state of being led toward the front of the apparatus body 100.

Subsequently, the connector 8*b* of the feeding unit 8 on the lamp body 1 side is connected to the connector 104*b* provided at the distal end of the connecting wire 104*a* drawn from the apparatus body 100, and a series of feeding wire 9 composed of the connecting wire 104*a*, the connector 104*b*, the feeding wire 8*a*, and the connector 8*b* is disposed so as to be stored in the storage depression 52 provided on the back side of the lamp body 1. Simultaneously, the bases 6 at the both ends of the tube lamp 50 are mounted on the sockets 102, respectively. Then, mounting of the tube lamp 50 with respect to the apparatus body 100 is completed.

Accordingly, the feeding wire 9 is stored in the storage depression 52, and is inhibited from protruding unintentionally. In this case, the storage depression 52 is provided along the longitudinal direction, the elongated feeding wire 9 is disposed along the storage depression 52, and the storage is easily achieved.

When the tube lamp 50 is mounted on the apparatus body 100 as described above, power is supplied from the feeding unit 8 to the tube lamp 50 and the tube lamp 50 is supported by the sockets 102 so that the mounted state can be hold. Depending on to the state of deterioration of the sockets 102, the sockets 102 may be replaced simultaneously with the replacement of the tube lamp 50.

Figure 25:
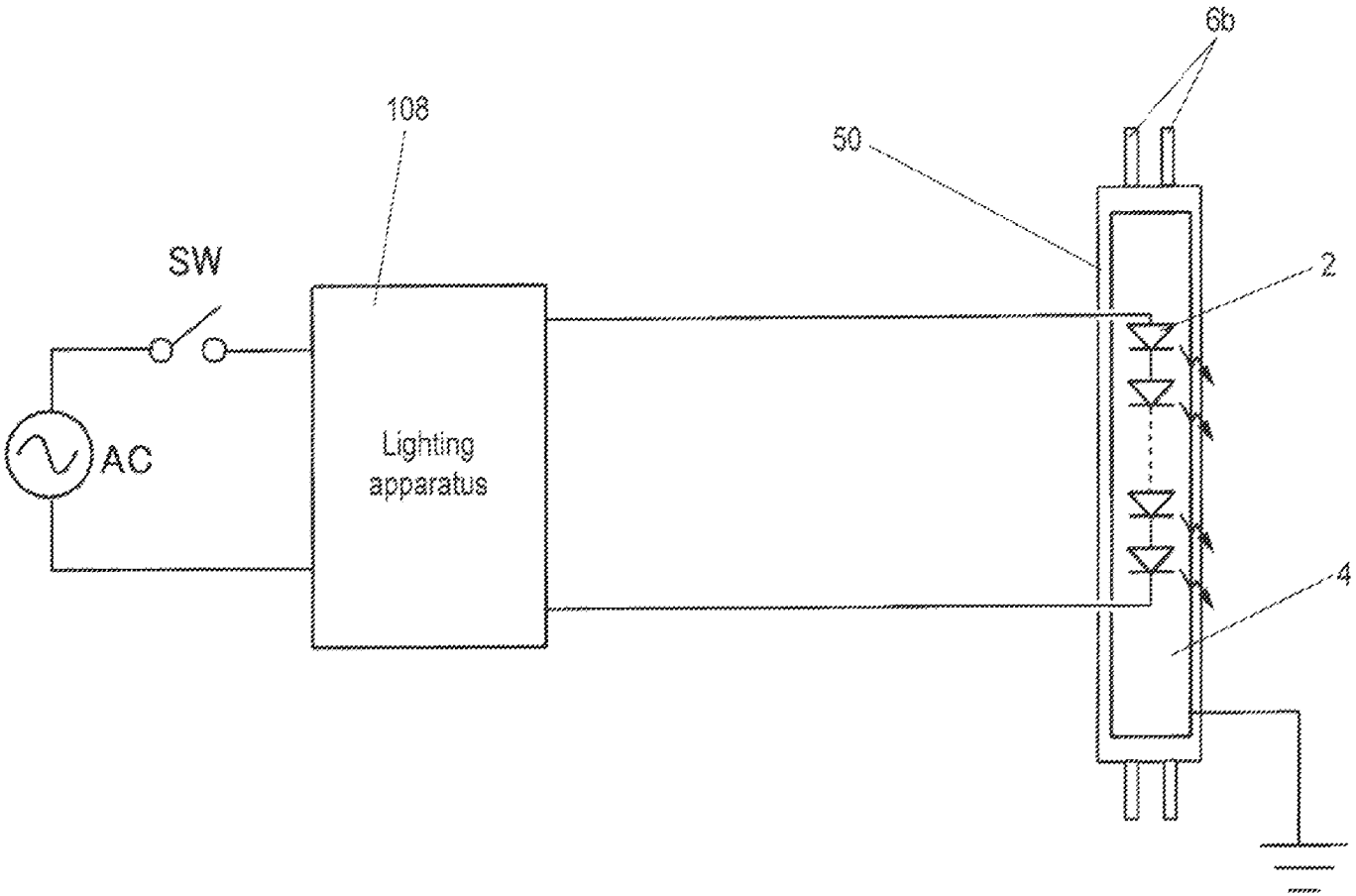
FIG. 25 is a circuit diagram of the luminaire in FIG. 18.

As illustrated in a connecting diagram in FIG. 25, the lighting apparatus 108 is connected to the commercial AC power supply AC, and the output from the lighting apparatus 108 is supplied to the LEDs 2. As is clear from FIG. 25, there is no component electrically connected to the two pins 6*b* projecting from the both ends of the lamp body 1, and. no power is supplied to the lamp body 1 via the bases 6, In the luminaire 500 configured as described above, when the power is supplied to the lighting apparatus 108, the plurality of LEDs 2 are energised via the connecting wire 104*a*, the connector 104*b*, the connector 8*b*, the feeding wire 8*a*, and the substrates 4 and the respective LEDs 2 are lit. The light emitted from the LEDs 2 passes through the translucent lamp body 1, and is radiated downward whereby a predetermined range is illuminated.

In this case, energisation of the tube lamp 50 is performed via the feeding unit 8, and the bases 6 are not energised via the sockets 102. Therefore, even though the sockets 102 are in the deteriorated state, a problem that the electrical connection becomes unstable is avoided. Therefore, the stability of the electric connection can be secured.

The feeding wire 9 including the connecting wire 104*a*, the connector 104*b*, the connector 8*b*, and the feeding wire 8*a* connected each other is stored in the storage depression 52 provided on the back side of the lamp body 1. Therefore the feeding wire 9 is prevented from projecting or protruding from the outer shell of the lamp body 1, so that the wiring process may be performed cohesively.

Furthermore, the feeding wire 9 is stored in the storage depression 52 on the back side of the tube lamp 50, therefore, the feeding wire 8 does not become the obstacle of radiation of light from the LEDs 2 or reflecting light from the reflecting panel 120. In addition, the connectors 8*b*, 104*b* formed of a synthetic resin material are stored and arranged in the storage depression 52, therefore, the dose of the UV-ray to be radiated on these connectors may be reduced to substantially zero by a long term use of the tube lamp 50, so that the deterioration of the connector due to the UV ray can be inhibited.

Incidentally, when the existing straight fluorescent lamp is replaced by the tube lamp 50, it is imagined that the apparatus body 100 has been used already for a long time to some extent. In other words, when the apparatus body 100 for mounting the tube lamp 50 is used for a long time, there is a probability of deterioration of the sockets 102 due to the influence of, in particular, heat or UV-ray. Therefore, when the tube lamp 50 is mounted on the sockets 102 of the apparatus body 100 deteriorated in this manner, the bases 6 of the tube lamp 50 may come apart from the sockets 102 due to vibrations or the like, and the tube lamp 50 may drop.

However, even though the bases 6 portion of the tube leap 50 come apart from the sockets 102, since one end of the tube lamp 50 is coupled to the apparatus body 100 via the connecting portion 104 and the feeding unit 8, there is no fear of dropping of the tube lamp 50.

Figure 24:
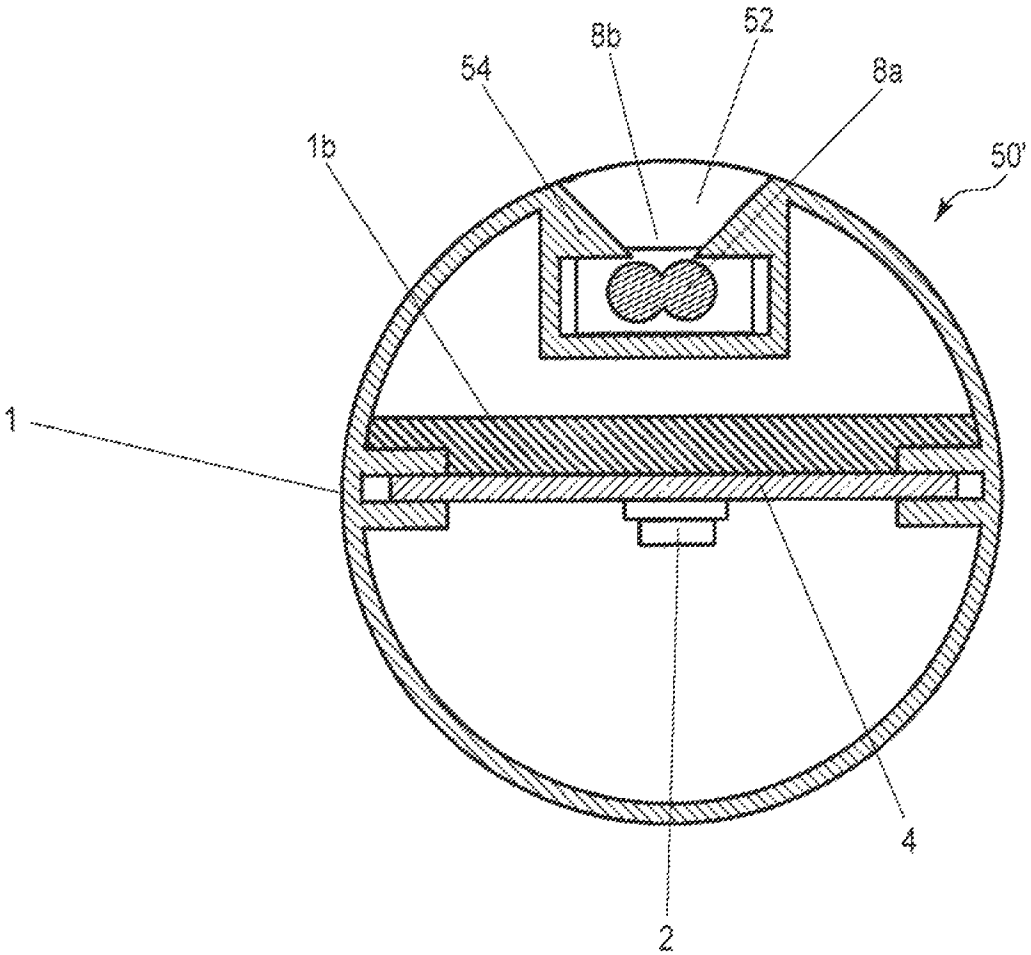
FIG. 24 is a cross-sectional view of a modification or the tube lamp in FIG. 23.

In FIG. 24, a modification of the fifth embodiment described above is illustrated. In this modification, the cap mounting portions 54 are provided at both sides of the opening in the storage depression 52 so as to prevent the feeding wire 9 from coming apart from the opening on the back side hereof. In this manner, with the provision of the cap mounting portions 54 at an edge of the opening of the storage depression 52, the storage of the feeding wire 9 in the storage depression 52 is ensured.

Figure 26:
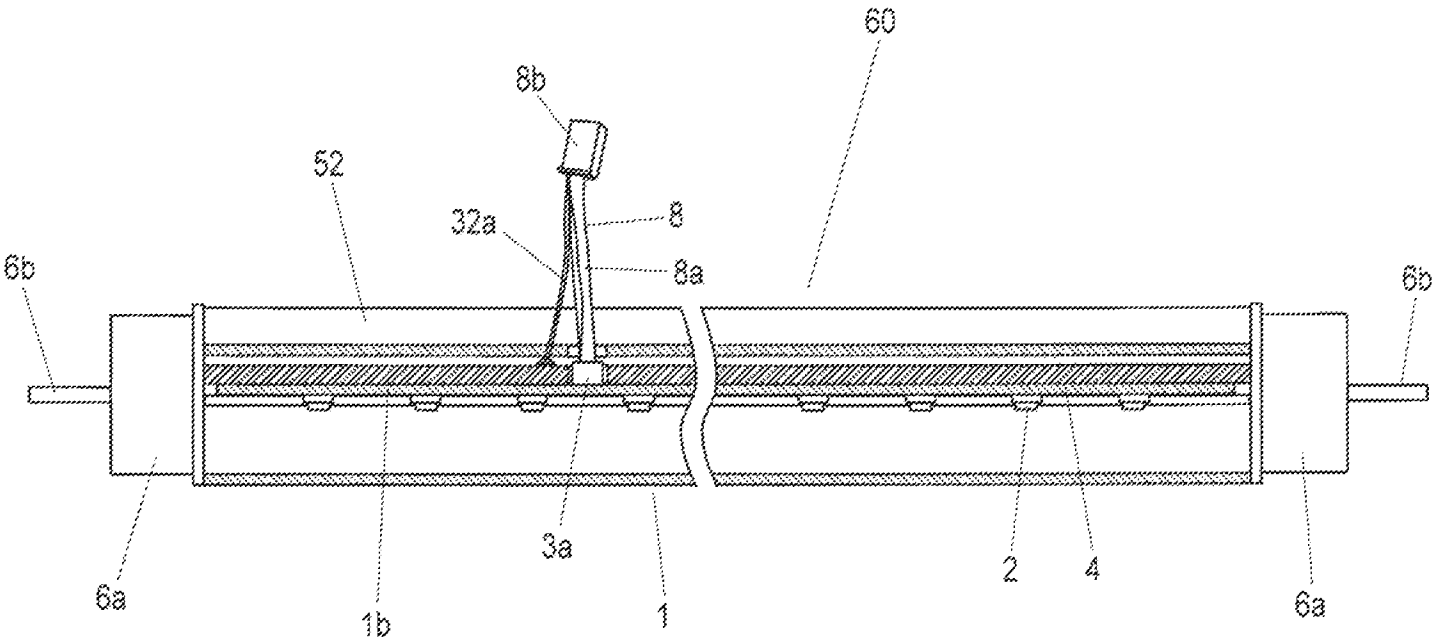
FIG. 26 is a cross-sectional view of a tube lamp according to a sixth embodiment taken along a tube axis.

Subsequently, a tube lamp 60 according to a sixth embodiment will be described with reference to FIG. 26. For reference, here, the components which function in the same manner as the fifth embodiment described above are designated by the same reference signs, and the detailed description is omitted.

The tube lamp 60 in this embodiment is characterised by etc structure in which the feeding wire 8*a* of the feeding unit 8 and the grounding wire 32*a* of the grounding portion 32 are drawn out together from the back side of the lamp body 1. The proximal end portion of the grounding wire 32*a* is fixed by a screwing to the back side of the thermal radiating unit 1*b*. The proximal portion of the feeding wire 8*a* is connected to the substrates 4 via the connectors 3*a* described above.

Then the distal end of the grounding wire 32*a* is connected to the connector 8*b* of the feeding unit 8 together. In other words, the feeding wire 8*a* for supplying power and the grounding wire 32*a* for grounding the tube lamp 60 are connected to the connector 8*b*, and these are configured to be connected by the single connector 8*b*. Therefore, the connecting operation of the feeding unit 8 and the grounding portion 32 can be performed at once.

According to the configuration as described above, in the same manner as the fifth embodiment described above, when the feeding wire 8*a* and the connector 8*b* are stored in the storage depression 52, the grounding wire 32*a* is stored in the storage depression 52 simultaneously. Since the storage depression 52 is formed on the back, side of the lamp body 1, the configurations of the feeding unit 8 and the grounding portion 32 are prevented from projecting or protruding from the shell of the lamp body 1, and the wiring process may be performed cohesively.

Figure 27:
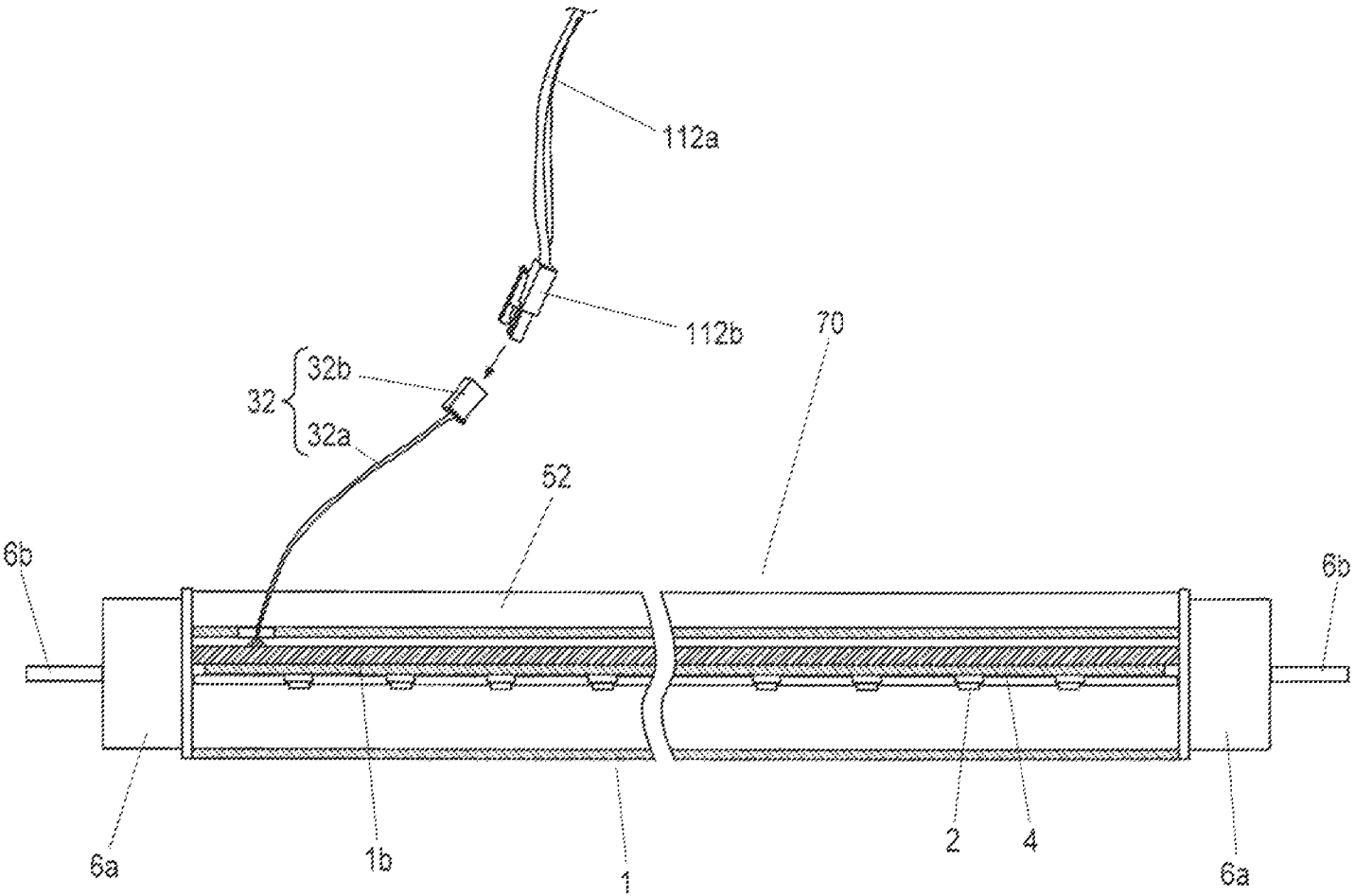
FIG. 27 is a cross-sectional view of a tune lamp according to a seventh embodiment taken along a tube axis.
Figure 28:
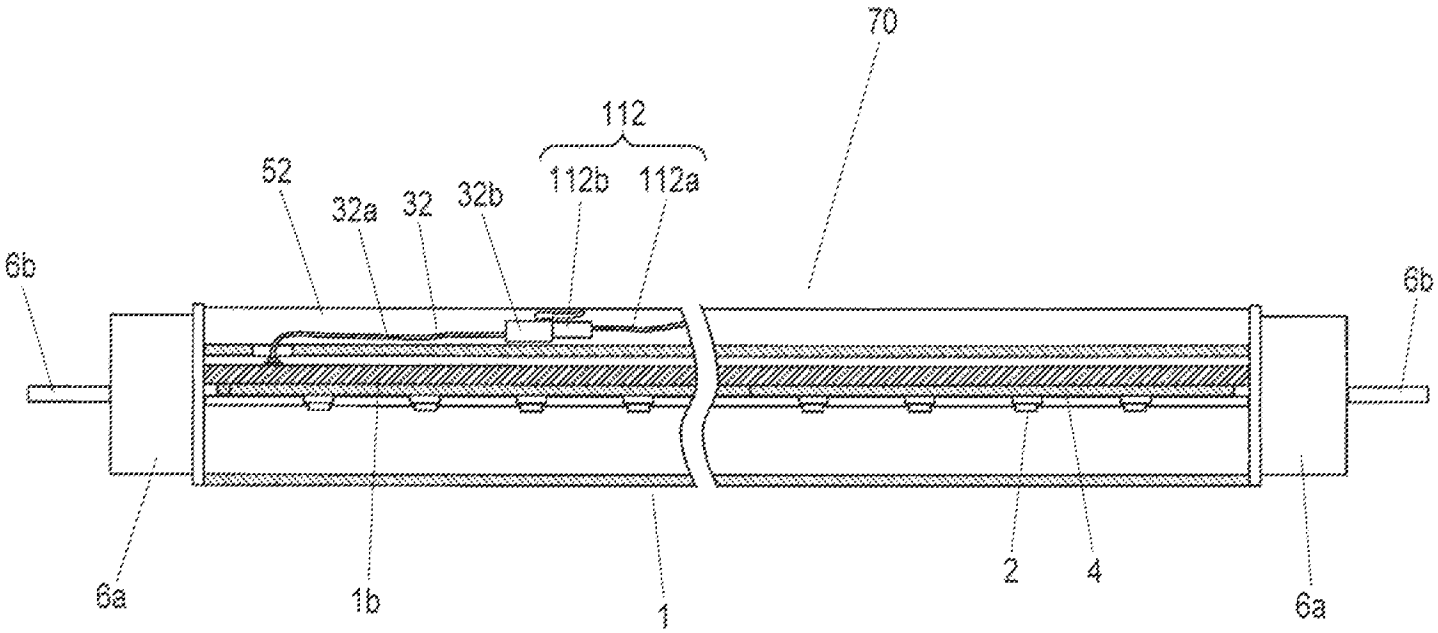
FIG. 28 is a cross-sectional, view of the tube lamp in FIG. 27 illustrating a state in which a grounding wire of the tube lamp in FIG. 27 is stored in a storage portion.

Subsequently, a tube lamp 70 according to a seventh embodiment will be described with reference to FIG. 27 and FIG. 28. for reference, here as well, the components which function in the same manner as the fifth embodiment described above are designated by the same reference signs, and the detailed description is omitted.

The tube lamp 70 in this embodiment, being different from the first to the sixth embodiments described above, is of a type distributing power via the bases 6 at the both ends of the lamp body 1. In other words, in the tube lamp 70, the power is distributed through the terminal of the sockets 102 in a state of being mounted on the apparatus body 100 in the same manner as the straight tube fluorescent lamp of the related art.

Therefore, instead of storing and arranging the feeding unit 8 of the fifth embodiment in the storage depression 52, in this embodiment, the grounding wire 32*a* of the grounding portion 32 is configured to be stored in the storage depression 52, The storage depression 52 is provided on the back side of the lamp body 1.

More specifically, the grounding portion 32 of the lamp body 1 side has the grounding wire 32*a* and a connector 32*b*. The proximal end potion of the grounding wire 32*a* is fixedly fastened to the thermal radiating unit 1*b* having conductivity in the lamp body 1 with the screw or the like. Then, the connector 32*b* of the grounding portion 32 of the lamp body 1 side is connected the connector 112*b* provided at the distal end of the grounding wire 112*a* drawn from the apparatus body 100.

In contrast, the earth terminal of the terminal bed 110 electrically connected to the conductive thermal radiating unit 1*b* is grounded via an earth wire, not shown. Therefore, the lamp body 1 is grounded, via the grounding wire 32*a*, the connector 32*b*, the grounding wire 112*a*, the connector 112*b*, the thermal radiating unit 1*b*, the terminal bed 110, and the earth wire.

As described thus far, according to the embodiment, in the same manner as the wiring process of the feeding wire 9 in the fifth embodiment, the grounding wire 32*a* and the connector 32*b* of the grounding portion 32 on the lamp body 1 side, the grounding wire 112*a* and the connector 112*b* led from the apparatus body 1 side can be stored in the storage depression 52 provided on the back side of the lamp body 1. Accordingly, the grounding wire connecting the lamp body 1 and the apparatus body 100 is prevented from projecting and protruding from the outer shell of the lamp body 1. The wiring process can be performed cohesively.

Although several, embodiments have been described these embodiments are shown only as examples and are not intended to limit the scope of the invention. These embodiments map be implemented in other various modes, and various omissions, replacements, and modifications may be made without departing from the scope of the invention. These embodiments and the modifications are included in the scope and gist of the invention, and are included in the invention claimed in claims and in the equivalent range.

For example, the tube lamp is not limited to a mode compatible with the straight tube fluorescent lamp. A mode compatible with a single base type fluorescent lamp is also applicable. The lighting apparatus 108 configured to perform, the lighting control of the LEDs 2 may be disposed on the apparatus body 100 side or the lamp body 1 side.

REFERENCE SIGNS LIST

1 lamp body
2 LED
4 substrate
6 base
8 feeding unit
8*a* feeding wire
8*b* connector
10 tube lamp
100 apparatus body
102 socket
120 reflecting panel

The invention claimed is:

1. A tube lamp comprising:

an elongated cylindrical lamp body having translucency;

a plurality of light-emitting elements arranged in the lamp body;

two mounting portions configured to mount both longitudinal ends of the lamp body respectively to sockets of an apparatus body; and a feeding unit provided on the lamp body separately from the two mounting portions for feeding power to the light-emitting element, the feeding unit including a feeding wire configured to suspend and support the lamp body from the apparatus body when at least one of the two mounting portions is not mounted to the respective socket.

2. The tube lamp of claim 1, wherein the mounting portions are connected to the sockets in an insulated state.

3. The tube lamp of claim 1, wherein the mounting portions include connectors to be connected to terminals of the sockets and fixtures configured to fix the connectors to both end portions of the lamp body in the longitudinal direction, and the connectors and the fixtures are connected in an insulated state.

4. The tube lamp of claim 1, wherein the mounting portions include two connectors to be connected to terminals of the sockets, and the two connectors are in the insulated state.

5. The tube lamp of claim 1, wherein the feeding unit is provided on the back side in the direction in which the lamp body faces the apparatus body.

6. The tube lamp of claim 5, further comprising a storage portion configured to store a grounding wire for grounding the lamp body, in the back side of the lamp body.

7. The tube lamp of claim 5, wherein the feeding unit includes a connector securely provided on the lamp body for connecting to an external power supply.

8. The tube lamp of claim 5, further comprising a storage portion configured to store the feeding wire connecting the apparatus body and the feeding unit and provided on the back side of the lamp body.

9. The tube lamp of claim 8, wherein the storage portion further stores a grounding wire for grounding the lamp body.

10. A luminaire comprising:

an apparatus body having a connecting portion;

two sockets; and a tube lamp comprising an elongated cylindrical lamp body having translucency;

a plurality of light-emitting elements arranged in the lamp body;

two mounting portions that mount both longitudinal ends of the lamp body respectively to the two sockets; and a feeding unit provided on the lamp body separately from the two mounting portions for feeding power to the light-emitting element, the feeding unit including a feeding wire configured to suspend and support the lamp body from the apparatus body when at least one of the two mounting portions is not mounted to the respective socket, and connected to the connecting portion near the two mounting portions.

11. The luminaire of claim 10, further comprising an insertion portion provided on the apparatus body adjacent to the socket for allowing insertion of the feeding wire connecting the connecting portion of the apparatus body and the feeding unit of the lamp body, between the apparatus body and the socket.

12. The luminaire of claim 10, further comprising an insertion portion provided on the apparatus body adjacent to the socket for allowing insertion of a grounding wire connecting the tube lamp and the apparatus body, between the apparatus body and the socket.

* * * * *